US012180569B2

(12) United States Patent
Hirashima et al.

(10) Patent No.: US 12,180,569 B2
(45) Date of Patent: Dec. 31, 2024

(54) HIGH-STRENGTH MEMBER, METHOD FOR MANUFACTURING HIGH-STRENGTH MEMBER, AND METHOD FOR MANUFACTURING STEEL SHEET FOR HIGH-STRENGTH MEMBER

(71) Applicant: JFE STEEL CORPORATION, Tokyo (JP)

(72) Inventors: Takuya Hirashima, Tokyo (JP); Shimpei Yoshioka, Tokyo (JP); Shinjiro Kaneko, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 791 days.

(21) Appl. No.: 17/289,951

(22) PCT Filed: Sep. 25, 2019

(86) PCT No.: PCT/JP2019/037688
§ 371 (c)(1),
(2) Date: Apr. 29, 2021

(87) PCT Pub. No.: WO2020/090302
PCT Pub. Date: May 7, 2020

(65) Prior Publication Data

US 2022/0010414 A1 Jan. 13, 2022

(30) Foreign Application Priority Data

Oct. 31, 2018 (JP) ..... 2018-204875
Jun. 28, 2019 (JP) ..... 2019-121143

(51) Int. Cl.
*C22C 38/02* (2006.01)
*C21D 8/02* (2006.01)
(Continued)

(52) U.S. Cl.
CPC ..... *C22C 38/02* (2013.01); *C21D 8/0226* (2013.01); *C21D 8/0236* (2013.01);
(Continued)

(58) Field of Classification Search
CPC ..... C22C 38/02; C22C 38/04; C22C 38/06; C22C 38/12; C22C 38/001; C22C 38/14;
(Continued)

(56) References Cited

U.S. PATENT DOCUMENTS

2016/0319385 A1 11/2016 Hasegawa et al.
2017/0037488 A1 2/2017 Hasegawa et al.
(Continued)

FOREIGN PATENT DOCUMENTS

CN 102971442 A 3/2013
CN 106048412 A 10/2016
(Continued)

OTHER PUBLICATIONS

JP 2002129279A Translation (Year: 2002).*
(Continued)

*Primary Examiner* — Brian D Walck
*Assistant Examiner* — Danielle Carda
(74) *Attorney, Agent, or Firm* — Oliff PLC

(57) ABSTRACT

A high-strength member having excellent delayed fracture resistance, a method for manufacturing the high-strength member, and a method for manufacturing a steel sheet for the high-strength member. The high-strength member has a bent ridge portion obtained by using a steel sheet having a tensile strength of 1470 MPa or more, an edge surface of the bent ridge portion has a residual stress of 800 MPa or less, and a longest crack among cracks that extend from the edge surface of the bent ridge portion in a bent ridge direction D1 has a length of 10 μm or less.

13 Claims, 2 Drawing Sheets

(51) Int. Cl.
*C21D 9/46* (2006.01)
*C22C 38/04* (2006.01)
*C22C 38/06* (2006.01)

(52) U.S. Cl.
CPC ..... *C21D 8/0273* (2013.01); *C21D 9/46* (2013.01); *C22C 38/04* (2013.01); *C22C 38/06* (2013.01); *C21D 2211/002* (2013.01); *C21D 2211/008* (2013.01)

(58) Field of Classification Search
CPC ..... C22C 38/16; C22C 38/60; C22C 38/08; C21D 8/0226; C21D 8/0236; C21D 8/0273; C21D 9/46; C21D 2211/002; C21D 2211/008; C21D 2211/003
USPC ..... 420/103
See application file for complete search history.

(56) References Cited

U.S. PATENT DOCUMENTS

| | | | | |
|---|---|---|---|---|
| 2018/0100212 | A1* | 4/2018 | Ono ..... | C21D 8/0236 |
| 2019/0017142 | A1 | 1/2019 | Hamamoto et al. | |
| 2019/0144966 | A1 | 5/2019 | Yabu et al. | |

FOREIGN PATENT DOCUMENTS

| | | | | | |
|---|---|---|---|---|---|
| CN | 107429349 | A | * | 12/2017 | ..... C21D 8/0236 |
| CN | 108603269 | A | | 9/2018 | |
| EP | 2 589 674 | A1 | | 5/2013 | |
| EP | 3 415 653 | A1 | | 12/2018 | |
| EP | 3 489 382 | A1 | | 5/2019 | |
| EP | 3486346 | A1 | | 5/2019 | |
| JP | 2002129279 | A | * | 5/2002 | |
| JP | 2003-166035 | A | | 6/2003 | |
| JP | 2008-189985 | A | | 8/2008 | |
| JP | 2013-221198 | A | | 10/2013 | |
| JP | 2014-025133 | A | | 2/2014 | |
| JP | 2015-117403 | A | | 6/2015 | |
| JP | 2017-125228 | A | | 7/2017 | |
| JP | 2017-155329 | A | | 9/2017 | |
| WO | 2015/093043 | A1 | | 6/2015 | |
| WO | 2018/030400 | A1 | | 2/2018 | |
| WO | 2018/062380 | A1 | | 4/2018 | |
| WO | 2018/062381 | A1 | | 4/2018 | |
| WO | 2018/127984 | A1 | | 7/2018 | |

OTHER PUBLICATIONS

Aug. 27, 2021 Extended European Search Report issued in European Application No. 19880423.9.
Liu, Sen, "Basic Technique of Automobile Metal Sheet Worker",76, p. 120, Oct. 31, 2010.
Nov. 23, 2021 Office Action issued in Chinese Patent Application No. 201980071910.
Dec. 24, 2019 International Search Report issued in International Application No. PCT/JP2019/037688.

* cited by examiner

HIGH-STRENGTH MEMBER, METHOD FOR MANUFACTURING HIGH-STRENGTH MEMBER, AND METHOD FOR MANUFACTURING STEEL SHEET FOR HIGH-STRENGTH MEMBER

TECHNICAL FIELD

This application relates to a high-strength member used for automotive parts and so forth, a method for manufacturing a high-strength member, and a method for manufacturing a steel sheet for a high-strength member. More specifically, the application relates to a high-strength member having excellent delayed fracture resistance, a method for manufacturing such a high-strength member, and a method for manufacturing a steel sheet for such a high-strength member.

BACKGROUND

In recent years, high-strength steel sheets of 1320 to 1470 MPa grade in tensile strength (TS) have been increasingly applied to vehicle body frame parts, such as center pillar R/F (reinforcement), bumpers, impact beams parts, and the like (hereinafter, also referred to as "parts"). Moreover, in view of further weight reduction of automobile bodies, the application of steel sheets of 1800 MPa (1.8 GPa) grade or higher in TS to parts therefor has also been investigated.

As the strength of steel sheets increases, the occurrence of delayed fracture becomes a concern. In recent years, delayed fracture of a sample processed into a part shape, particularly delayed fracture originating from a sheared edge surface of a bent portion where strains are concentrated, has been of concern. Accordingly, it is important to suppress such delayed fracture originating from a sheared edge surface.

Patent Literature 1, for example, provides a steel sheet that comprises steel whose chemical composition satisfy C: 0.05 to 0.3%, Si: 3.0% or less, Mn: 0.01 to 3.0%, P: 0.02% or less, S: 0.02% or less, Al: 3.0% or less, and N: 0.01% or less with the balance being Fe and incidental impurities and that exhibits excellent delayed fracture resistance after forming by specifying the grain size and density of Mg oxide, sulfide, complex crystallized products, and complex precipitate.

Patent Literature 2 provides a method for manufacturing a formed member having excellent delayed fracture resistance by subjecting a sheared edge surface of a steel sheet having TS of 1180 MPa or more to shot peening, thereby reducing the residual stress of the edge surface.

CITATION LIST

Patent Literature

PTL 1: Japanese Unexamined Patent Application Publication No. 2003-166035

PTL 2: Japanese Unexamined Patent Application Publication No. 2017-125228

SUMMARY

Technical Problem

The technique disclosed in Patent Literature 1 provides a steel sheet having excellent delayed fracture resistance by specifying the chemical composition as well as the grain size and density of precipitates in steel. However, due to the small amount of added C, the steel sheet of Patent Literature 1 has a lower strength than a steel sheet used for the high-strength member of the disclosed embodiments and has TS of less than 1470 MPa. In the steel sheet of Patent Literature 1, it is presumed that even if the strength is increased by, for example, increasing the amount of C, delayed fracture resistance deteriorates since the residual stress of an edge surface also increases as the strength increases.

The technique disclosed in Patent Literature 2 provides a formed member having excellent delayed fracture resistance by subjecting a sheared edge surface to shot peening, thereby reducing the residual stress of the edge surface. However, delayed fracture occurs even when the residual stress of the edge surface is 800 MPa or less, which is specified in the disclosed embodiments. This is presumably because the crack length of the edge surface is longer than the length specified in the disclosed embodiments. When the edge surface remains as a sheared edge surface even after subjected to shot peening, cracks formed by shearing exceed 10 μm. Consequently, the effects of improving delayed fracture resistance are unsatisfactory.

The disclosed embodiments have been made in view of the above, and an object of the disclosed embodiments is to provide a high-strength member having excellent delayed fracture resistance, a method for manufacturing a high-strength member, and a method for manufacturing a steel sheet for a high-strength member.

In the disclosed embodiments, "high strength" means a tensile strength (TS) of 1470 MPa or more.

In the disclosed embodiments, "excellent delayed fracture resistance" means that a critical load stress is equal to or higher than a yield strength (YS). As described in the EXAMPLES, the critical load stress is measured as the maximum load stress without a delayed fracture when a member obtained by bending a steel sheet is immersed in hydrochloric acid at pH=1 (25° C.).

Solution to Problem

As a result of intensive studies conducted to resolve the above-mentioned problems, the present inventors found possible to attain a high-strength member having excellent delayed fracture resistance, thereby arriving at the disclosed embodiments. The high-strength member is attained by controlling, in a high-strength member that is obtained using a steel sheet to have a bent ridge portion, a tensile strength of the member to 1470 MPa or more; a residual stress of an edge surface of the bent ridge portion to 800 MPa or less; and a length of the longest crack among cracks that extend from the edge surface of the bent ridge portion in the bent ridge direction to 10 μm or less. The above-mentioned problems are resolved by the following means.

[1] A high-strength member having a bent ridge portion obtained by using a steel sheet, wherein: the member has a tensile strength of 1470 MPa or more; an edge surface of the bent ridge portion having a residual stress of 800 MPa or less; and a longest crack among cracks that extend from the edge surface of the bent ridge portion in a bent ridge direction has a length of 10 μm or less.

[2] The high-strength member according to [1], where the steel sheet comprises: an element composition containing, in mass %, C: 0.17% or more and 0.35% or less, Si: 0.001% or more and 1.2% or less, Mn: 0.9% or more and 3.2% or less, P: 0.02% or less, S: 0.001% or less, Al: 0.01% or more and 0.2% or less, and N: 0.010% or less, the balance being Fe and incidental impurities; and a microstructure including one or two of bainite containing carbide grains having an average grain size of 50 nm or less and martensite containing carbide grains having an average grain size of 50 nm or less with a total area fraction of 90% or more based on the entire microstructure of the steel sheet.

[3] The high-strength member according to [1], where the steel sheet comprises: an element composition containing, in mass %, C: 0.17% or more and 0.35% or less, Si: 0.001% or more and 1.2% or less, Mn: 0.9% or more and 3.2% or less, P: 0.02% or less, S: 0.001% or less, Al: 0.01% or more and 0.2% or less, N: 0.010% or less, and Sb: 0.001% or more and 0.1% or less, the balance being Fe and incidental impurities; and a microstructure including one or two of bainite containing carbide grains having an average grain size of 50 nm or less and martensite containing carbide grains having an average grain size of 50 nm or less with a total area fraction of 90% or more based on the entire microstructure of the steel sheet.

[4] The high-strength member according to [2] or [3], where the element composition of the steel sheet further contains, in mass %, B: 0.0002% or more and less than 0.0035%.

[5] The high-strength member according to any one of [2] to [4], where the element composition of the steel sheet further contains, in mass %, at least one selected from Nb: 0.002% or more and 0.08% or less and Ti: 0.002% or more and 0.12% or less.

[6] The high-strength member according to any one of [2] to [5], where the element composition of the steel sheet further contains, in mass %, at least one selected from Cu: 0.005% or more and 1% or less and Ni: 0.005% or more and 1% or less.

[7] The high-strength member according to any one of [2] to [6], where the element composition of the steel sheet further contains, in mass %, at least one selected from Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less.

[8] The high-strength member according to any one of [2] to [7], where the element composition of the steel sheet further contains, in mass %, at least one selected from Ca: 0.0002% or more and 0.0030% or less, Ce: 0.0002% or more and 0.0030% or less, La: 0.0002% or more and 0.0030% or less, and Mg: 0.0002% or more and 0.0030% or less.

[9] The high-strength member according to any one of [2] to [8], where the element composition of the steel sheet further contains, in mass %, Sn: 0.002% or more and 0.1% or less.

[10] A method for manufacturing a high-strength member including an edge surface processing step, the edge surface processing step including, after cutting out a steel sheet having a tensile strength of 1470 MPa or more, subjecting an edge surface formed by the cutting to a surface trimming before or after a bending, and heating the edge surface at a temperature of 270° C. or lower after the bending and the surface trimming.

[11] A method for manufacturing a high-strength member including an edge surface processing step, the edge surface processing step including, after cutting out a steel sheet according to any one of [2] to [9], subjecting an edge surface formed by the cutting to a surface trimming before or after a bending, and heating the edge surface at a temperature of 270° C. or lower after the bending and the surface trimming.

[12] A method for manufacturing a steel sheet for manufacturing the high-strength member according to any one of [2] to [9], the method including: a step of subjecting a steel having the element composition described above to a hot rolling and a cold rolling; and an annealing step including heating a cold-rolled steel sheet obtained by the cold rolling to an annealing temperature of $A_{c3}$ point or higher, cooling the cold-rolled steel sheet to a cooling stop temperature of 350° C. or lower at an average cooling rate of 3° C./s or more in a temperature range from the annealing temperature to 550° C., and then holding the cold-rolled steel sheet in a temperature range of 100° C. or higher and 260° C. or lower for 20 seconds or more and 1,500 seconds or less.

Advantageous Effects

According to the disclosed embodiments, it is possible to provide a high-strength member having excellent delayed fracture resistance, a method for manufacturing a high-strength member, and a method for manufacturing a steel sheet for manufacturing a high-strength member. Moreover, by applying the high-strength member of the disclosed embodiments to automobile structural members, it is possible both to increase the strength and to enhance the delayed fracture resistance of automotive steel sheets. In other words, the disclosed embodiments enhance the performance of automobile bodies.

DETAILED DESCRIPTION

Figure 1:
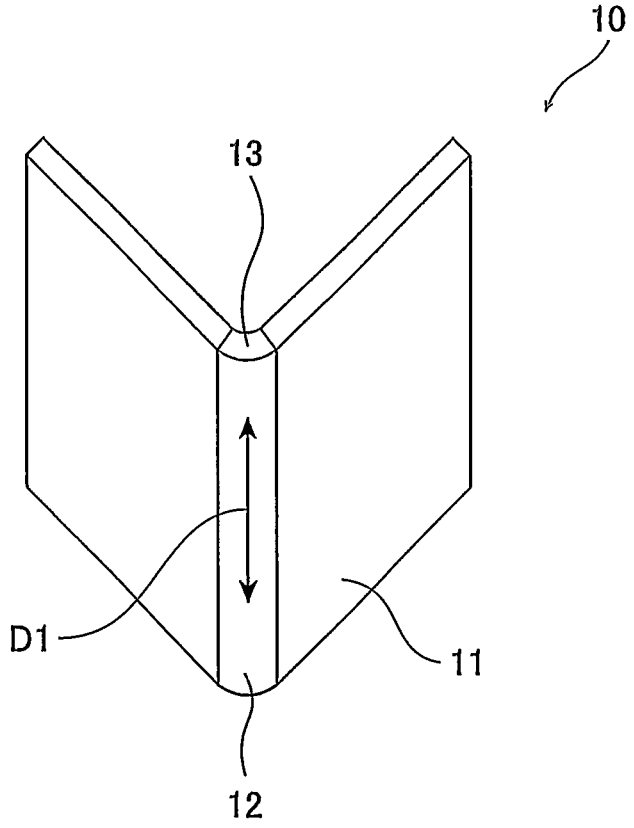
FIG. 1 is a perspective view illustrating an exemplary high-strength member of an embodiment.

Hereinafter, embodiments will be described. However, it will be understood that the disclosure is not intended to be limited to the following embodiments.

A high-strength member of the disclosed embodiments is a high-strength member that is obtained using a steel sheet to have a bent ridge portion, where the member has a tensile strength of 1470 MPa or more; an edge surface of the bent ridge portion has a residual stress of 800 MPa or less; and a longest crack among cracks that extend from the edge surface of the bent ridge portion in a bent ridge direction has a length of 10 μm or less.

Provided that a high-strength member satisfying these conditions can be obtained, a steel sheet used for the high-strength member is not particularly limited. Hereinafter, a preferable steel sheet for obtaining the high-strength member of the disclosed embodiments will be described. However, a steel sheet used for the high-strength member of the disclosed embodiments is not limited to steel sheets described hereinafter.

A preferable steel sheet for obtaining a high-strength member may have the element composition and the microstructure described hereinafter. Here, a steel sheet having the element composition and the microstructure described hereinafter need not necessarily be used provided that the high-strength member of the disclosed embodiments can be obtained.

First, the preferable element composition of a preferable steel sheet (raw material steel sheet) used for a high-strength member will be described. In the following description of the preferable element composition, "%" as a unit of element contents indicates "mass %."

<C: 0.17% or More and 0.35% or Less>

C is an element that enhances hardenability. From a viewpoint of ensuring the predetermined total area fraction of one or two of martensite and bainite as well as ensuring TS≥1470 MPa by increasing the strength of martensite and bainite, C content is preferably 0.17% or more, more preferably 0.18% or more, and further preferably 0.19% or more. Meanwhile, when C content exceeds 0.35%, even if an edge surface (sheet thickness surface) is subjected to surface trimming before or after bending and is heated after the bending, the residual stress of the edge surface of a bent ridge portion could exceed 800 MPa, thereby impairing delayed fracture resistance. Accordingly, C content is preferably 0.35% or less, more preferably 0.33% or less, and further preferably 0.31% or less.

<Si: 0.001% or More and 1.2% or Less>

Si is an element for strengthening through solid-solution strengthening. Moreover, when a steel sheet is held in a temperature range of 200° C. or higher, Si suppresses excessive formation of coarse carbide grains and thus contributes to the enhancement of elongation. Further, Si reduces Mn segregation in the central part of the sheet thickness and thus also contributes to suppressed formation of MnS. To obtain the above-mentioned effects satisfactorily, Si content is preferably 0.001% or more, more preferably 0.003% or more, and further preferably 0.005% or more. Meanwhile, when Si content is excessively high, coarse MnS is readily formed in the sheet thickness direction, thereby promoting crack formation during bending and impairing delayed fracture resistance. Accordingly, Si content is preferably 1.2% or less, more preferably 1.1% or less, and further preferably 1.0% or less.

<Mn: 0.9% or More and 3.2% or Less>

Mn is contained to enhance hardenability of steel and to ensure the predetermined total area fraction of one or two of martensite and bainite. When Mn content is less than 0.9%, ferrite formation in the surface layer portion of a steel sheet could lower the strength. Accordingly, Mn content is preferably 0.9% or more, more preferably 1.0% or more, and further preferably 1.1% or more. Meanwhile, to prevent MnS from increasing and promoting crack formation during bending, Mn content is preferably 3.2% or less, more preferably 3.1% or less, and further preferably 3.0% or less.

<P: 0.02% or Less>

P is an element that strengthens steel, but the high content promotes crack initiation and impairs delayed fracture resistance. Accordingly, P content is preferably 0.02% or less, more preferably 0.015% or less, and further preferably 0.01% or less. Meanwhile, although the lower limit of P content is not particularly limited, the current industrially feasible lower limit is about 0.003%.

<S: 0.001% or Less>

S forms inclusions, such as MnS, TiS, and Ti(C, S). To suppress crack initiation due to such inclusions, S content is preferably set to 0.001% or less. S content is more preferably 0.0009% or less, further preferably 0.0007% or less, and particularly preferably 0.0005% or less. Meanwhile, although the lower limit of S content is not particularly limited, the current industrially feasible lower limit is about 0.0002%.

<Al: 0.01% or More and 0.2% or Less>

Al is added to perform sufficient deoxidization and to reduce coarse inclusions in steel. To obtain such effects, Al content is preferably 0.01% or more and more preferably 0.015% or more. Meanwhile, when Al content exceeds 0.2%, Fe-based carbides, such as cementite, formed during coiling after hot rolling are less likely to dissolve in the annealing step. As a result, coarse inclusions or carbide grains could be formed, thereby promoting crack initiation and impairing delayed fracture resistance. Accordingly, Al content is preferably 0.2% or less, more preferably 0.17% or less, and further preferably 0.15% or less.

<N: 0.010% or Less>

N is an element that forms coarse inclusions of nitrides and carbonitrides, such as TiN, (Nb, Ti) (C, N), and AlN, in steel and promotes crack initiation through formation of such inclusions. To suppress deterioration in delayed facture resistance, N content is preferably 0.010% or less, more preferably 0.007% or less, and further preferably 0.005% or less. Meanwhile, although the lower limit of N content is not particularly limited, the current industrially feasible lower limit is about 0.0006%.

<Sb: 0.001% or More and 0.1% or Less>

Sb suppresses oxidation and nitriding in the surface layer portion of a steel sheet, thereby suppressing decarburization due to oxidation or nitriding in the surface layer portion of the steel sheet. By suppressing decarburization and thus suppressing ferrite formation in the surface layer portion of a steel sheet, Sb contributes to the increase in strength. Further, delayed fracture resistance is also enhanced by suppressing decarburization. In this view, Sb content is preferably 0.001% or more, more preferably 0.002% or more, and further preferably 0.003% or more. Meanwhile, when Sb content exceeds 0.1%, Sb segregates to prior-austenite (γ) grain boundaries and promotes crack initiation. Consequently, delayed fracture resistance could deteriorate. Accordingly, Sb content is preferably 0.1% or less, more preferably 0.08% or less, and further preferably 0.06% or less. Although Sb is preferably contained, Sb need not be contained when the effects of increasing the strength and enhancing delayed fracture resistance of a steel sheet can be obtained satisfactorily without including Sb.

Preferable steel used for the high-strength member of the disclosed embodiments desirably and basically contains the above-described elements with the balance being iron and incidental impurities and may contain the following acceptable elements (optional elements) unless the effects of the disclosed embodiments are lost.

<B: 0.0002% or More and Less than 0.0035%>

B is an element that enhances hardenability of steel and has an advantage of forming the predetermined area fraction of martensite and bainite even when Mn content is low. To obtain such effects of B, B content is preferably 0.0002% or more, more preferably 0.0005% or more, and further preferably 0.0007% or more. Moreover, from a viewpoint of fixing N, combined addition with 0.002% or more of Ti is preferable. Meanwhile, when B content is 0.0035% or more, the dissolution rate of cementite during annealing slows down to leave undissolved Fe-based carbides, such as cementite. Consequently, coarse inclusions and carbide grains are formed to promote crack initiation and impair delayed fracture resistance. Accordingly, B content is preferably less than 0.0035%, more preferably 0.0030% or less, and further preferably 0.0025% or less.

<At Least One Selected from Nb: 0.002% or More and 0.08% or Less and Ti: 0.002% or More and 0.12% or Less>

Nb and Ti contribute to the increase in strength through refinement of prior-austenite (γ) grains. In this view, Nb content and Ti content are each preferably 0.002% or more, more preferably 0.003% or more, and further preferably 0.005% or more. Meanwhile, when Nb or Ti is contained in a large amount, there are increased coarse Nb-based precipitates, such as NbN, Nb(C, N), and (Nb, Ti) (C, N), or coarse Ti-based precipitates, such as TiN, Ti(C, N), Ti(C, S), and TiS, that remain undissolved during slab heating in the hot rolling step. Consequently, crack initiation is promoted to impair delayed fracture resistance. Accordingly, Nb content is preferably 0.08% or less, more preferably 0.06% or less, and further preferably 0.04% or less. Meanwhile, Ti content is preferably 0.12% or less, more preferably 0.10% or less, and further preferably 0.08% or less.

<At Least One Selected from Cu: 0.005% or More and 1% or Less and Ni: 0.005% or More and 1% or Less>

Cu and Ni effectively enhance corrosion resistance in an environment in which automobiles are used and suppress hydrogen entry into a steel sheet by covering the steel sheet surface with corrosion products. From a viewpoint of enhancing delayed fracture resistance, Cu and Ni are contained at preferably 0.005% or more and more preferably 0.008% or more. Meanwhile, excessive Cu or Ni causes formation of surface defects and impairs plating properties or chemical conversion properties. Accordingly, Cu content and Ni content are each preferably 1% or less, more preferably 0.8% or less, and further preferably 0.6% or less.

<At Least One Selected from Cr: 0.01% or More and 1.0% or Less, Mo: 0.01% or More and Less than 0.3%, V: 0.003% or More and 0.5% or Less, Zr: 0.005% or More and 0.20% or Less, and W: 0.005% or More and 0.20% or Less>

Cr, Mo, and V may be included for the purpose of effectively enhancing hardenability of steel. To obtain the effect, Cr content and Mo content are each preferably 0.01% or more, more preferably 0.02% or more, and further preferably 0.03% or more, whereas V content is preferably 0.003% or more, more preferably 0.005% or more, and further preferably 0.007% or more. Meanwhile, any of these elements in an excessive amount promotes crack initiation and impairs delayed fracture resistance due to coarsened carbide grains. Accordingly, Cr content is preferably 1.0% or less, more preferably 0.4% or less, and further preferably 0.2% or less. Mo content is preferably less than 0.3%, more preferably 0.2% or less, and further preferably 0.1% or less. V content is preferably 0.5% or less, more preferably 0.4% or less, and further preferably 0.3% or less.

Zr and W contribute to the increase in strength through refinement of prior-austenite (γ) grains. In this view, Zr content and W content are each preferably 0.005% or more, more preferably 0.006% or more, and further preferably 0.007% or more. Meanwhile, a high content of Zr or W increases coarse precipitates that remain undissolved during slab heating in the hot rolling step. Consequently, crack initiation is promoted to impair delayed fracture resistance. Accordingly, Zr content and W content are each preferably 0.20% or less, more preferably 0.15% or less, and further preferably 0.10% or less.

<At Least One Selected from Ca: 0.0002% or More and 0.0030% or Less, Ce: 0.0002% or More and 0.0030% or Less, La: 0.0002% or More and 0.0030% or Less, and Mg: 0.0002% or More and 0.0030% or Less>

Ca, Ce, and La contribute to the improvement in delayed fracture resistance by fixing S as sulfides. Accordingly, the contents of these elements are each preferably 0.0002% or more, more preferably 0.0003% or more, and further preferably 0.0005% or more. Meanwhile, when these elements are added in large amounts, coarsened sulfides promote crack initiation and impair delayed fracture resistance. Accordingly, the contents of these elements are each preferably 0.0030% or less, more preferably 0.0020% or less, and further preferably 0.0010% or less.

Mg fixes O as MgO and acts as trapping sites of hydrogen in steel, thereby contributing to the improvement in delayed fracture resistance. Accordingly, Mg content is preferably 0.0002% or more, more preferably 0.0003% or more, and further preferably 0.0005% or more. Meanwhile, when Mg is added in a large amount, coarsened MgO promotes crack initiation and impairs delayed fracture resistance. Accordingly, Mg content is preferably 0.0030% or less, more preferably 0.0020% or less, and further preferably 0.0010% or less.

<Sn: 0.002% or More and 0.1% or Less>

Sn suppresses oxidation or nitriding in the surface layer portion of a steel sheet, thereby suppressing decarburization due to oxidation or nitriding in the surface layer portion of the steel sheet. By suppressing decarburization and thus suppressing ferrite formation in the surface layer portion of a steel sheet, Sn contributes to the increase in strength. In this view, Sn content is preferably 0.002% or more, more preferably 0.003% or more, and further preferably 0.004% or more. Meanwhile, when Sn content exceeds 0.1%, Sn segregates to prior-austenite (γ) grain boundaries and promotes crack initiation. Consequently, delayed fracture resistance deteriorates. Accordingly, Sn content is preferably 0.1% or less, more preferably 0.08% or less, and further preferably 0.06% or less.

Next, the preferable microstructure of a preferable steel sheet used for the high-strength member of the disclosed embodiments will be described.

<Based on Entire Microstructure of Steel Sheet, Total Area Fraction of One or Two of Bainite that Contains Carbide Grains Having Average Grain Size of 50 nm or Less and Martensite that Contains Carbide Grains Having Average Grain Size of 50 nm or Less is 90 or More>

To attain high strength of TS≥1470 MPa, it is preferable to control the total area fraction of one or two of bainite that contains carbide grains having an average grain size of 50 nm or less and martensite that contains carbide grains having an average grain size of 50 nm or less to 90% or more based on the entire microstructure of a steel sheet. When the area fraction is less than 90%, ferrite increases while lowering the strength. Here, the total area fraction of martensite and bainite may be 100% based on the entire microstructure. Moreover, the area fraction of one of the martensite and the bainite may be within the above-mentioned range, or the total area fraction of the both may fall within the above-mentioned range. Further, from a viewpoint of increasing the strength, the area fraction is more preferably 91% or more, further preferably 92% or more, and particularly preferably 93% or more.

Martensite is regarded as the total of as-quenched martensite and tempered martensite that has been tempered. In the disclosed embodiments, martensite indicates a hard microstructure formed from austenite at a low temperature (martensite transformation temperature or lower), and tempered martensite indicates a microstructure tempered during reheating of martensite. Meanwhile, bainite indicates a hard microstructure which is formed from austenite at a relatively low temperature (martensite transformation temperature or higher) and in which fine carbide grains are dispersed in acicular or plate-like ferrite.

Here, the remaining microstructure excluding martensite and bainite comprises ferrite, pearlite, and retained austenite. The total of 10% or less is acceptable and the total may be 0%.

In the disclosed embodiments, ferrite is a microstructure that is formed through transformation of austenite at a relatively high temperature and that comprises bcc grains, pearlite is a lamellar microstructure formed of ferrite and cementite, and retained austenite is austenite that has not undergone martensite transformation since the martensite transformation temperature becomes room temperature or lower.

The "carbide grains having an average grain size of 50 nm or less" in the disclosed embodiments means fine carbide grains observable within bainite and martensite under an SEM. Specific examples include Fe carbide grains, Ti carbide grains, V carbide grains, Mo carbide grains, W carbide grains, Nb carbide grains, and Zr carbide grains.

Here, a steel sheet may have a coated layer, such as a hot-dip galvanized layer. Exemplary coated layers include an electroplated layer, an electroless plated layer, and a hot-dipped layer. Further, the coated layer may be an alloyed coating layer.

Next, a high-strength member will be described.

[High-Strength Member]

A high-strength member of the disclosed embodiments is a high-strength member that is obtained using a steel sheet to have a bent ridge portion, where the member has a tensile strength of 1470 MPa or more; an edge surface of the bent ridge portion has a residual stress of 800 MPa or less; and a longest crack among cracks that extend from the edge surface of the bent ridge portion in a bent ridge direction has a length of 10 μm or less.

The high-strength member of the disclosed embodiments is obtained using a steel sheet and is a formed member obtained through processing, such as forming and bending, into a predetermined shape. The high-strength member of the disclosed embodiments can be suitably used for automotive parts, for example.

The high-strength member of the disclosed embodiments has a bent ridge portion. The "bent ridge portion" in the disclosed embodiments indicates a region that is no longer a flat plate by subjecting a steel sheet to bending. An exemplary high-strength member 10 illustrated in FIG. 1 is obtained by subjecting a steel sheet 11 to V-bending. The high-strength member 10 has a bent ridge portion 12 on the lateral side of the bent part of the steel sheet 11. An edge surface 13 of the bent ridge portion 12 is a sheet thickness face positioned on the side surface of the bent ridge portion 12. A bent ridge direction D1 in the disclosed embodiments is a direction parallel to the bent ridge portion 12.

The angle of bending is not particularly limited provided that the edge surface of the bent ridge portion has a residual stress of 800 MPa or less; and a longest crack among cracks that extend from the edge surface of the bent ridge portion in a bent ridge direction has a length of 10 μm or less.

The exemplary high-strength member 10 illustrated in FIG. 1 is bent in one location but may be bent in two or more locations to have two or more bent ridge portions.

<Member Having Tensile Strength of 1470 MPa or More>

The high-strength member has a tensile strength (TS) of 1470 MPa or more. To attain a tensile strength (TS) of 1470 MPa or more, the above-described steel sheet is preferably used.

Tensile strength (TS) and yield strength (YS) in the disclosed embodiments are calculated through measurement in the flat part of a high-strength member that has not been subjected to bending. Moreover, once the tensile strength (TS) and yield strength (YS) of an annealed steel sheet (steel sheet after the annealing step) before bending are measured, these measured values can be regarded as the measured values of the tensile strength (TS) and yield strength (YS) for a high-strength member obtained using the annealed steel sheet. The strength of a member can be calculated by the method described in the Examples section.

<Edge Surface of Bent Ridge Portion Having Residual Stress of 800 MPa or Less>

The edge surface (sheet thickness surface) of a bent ridge portion of a high-strength member has a residual stress of 800 MPa or less. As a result, since crack initiation is less likely to occur on the edge surface of the bent ridge portion, it is possible to obtain a member having excellent delayed fracture resistance. From a viewpoint of suppressing crack initiation due to delayed fracture, the residual stress is 800 MPa or less, preferably 700 MPa or less, more preferably 600 MPa or less, further preferably 400 MPa or less, and most preferably 200 MPa or less. The residual stress of the edge surface of a bent ridge portion can be calculated by the method described in the Examples section of the present specification.

<Longest Crack Among Cracks that Extend from Edge Surface of Bent Ridge Portion in Bent Ridge Direction Having Length of 10 μm or Less>

A longest crack among cracks that extend from an edge surface of the bent ridge portion in a bent ridge direction has a length (hereinafter, also simply referred to as crack length) of 10 μm or less. By reducing the crack length, large cracks are unlikely to be formed on the edge surface of the bent ridge portion. Consequently, it is possible to obtain a member having excellent delayed fracture resistance. From a viewpoint of suppressing delayed fracture through the reduction in crack length, the crack length is 10 μm or less, preferably 8 μm or less, and more preferably 5 μm or less. The crack length can be calculated by the method as described in the Examples section of the present specification.

Next, an embodiment of the method for manufacturing a high-strength member of the disclosed embodiments will be described.

An exemplary embodiment of the method for manufacturing a high-strength member of the disclosed embodiments includes an edge surface processing step of, after cutting out a steel sheet having a tensile strength of 1470 MPa or more, subjecting an edge surface formed by the cutting to surface trimming before or after bending, and heating the edge surface at a temperature of 270° C. or lower after the bending and the surface trimming.

Moreover, another exemplary embodiment of the method for manufacturing a high-strength member of the disclosed embodiments includes an edge surface processing step of, after cutting out a steel sheet having the above-described element composition and microstructure, subjecting an edge surface formed by the cutting to surface trimming before or after bending, and heating the edge surface at a temperature of 270° C. or lower after the bending and the surface trimming.

Further, an exemplary embodiment of the method for manufacturing a steel sheet for a high-strength member of the disclosed embodiments includes: a step of subjecting steel (steel raw material) having the above-described element composition to hot rolling and cold rolling; and an annealing step including: heating a cold-rolled steel sheet obtained by the cold rolling to an annealing temperature of $A_{c3}$ point or higher, cooling the steel sheet to a cooling stop temperature of 350° C. or lower at an average cooling rate of 3° C./s or more in a temperature range from the annealing temperature to 550° C., and then holding the steel sheet in a temperature range of 100° C. or higher and 260° C. or lower for 20 seconds or more and 1,500 seconds or less. Hereinafter, these steps as well as a preferable casting step performed before the hot rolling step will be described. Temperatures mentioned hereinafter mean the surface temperatures of a slab, a steel sheet, and so forth.

[Casting Step]

Steel having the foregoing element composition is cast. The casting speed is not particularly limited. However, to suppress formation of the above-mentioned inclusions and to enhance delayed fracture resistance, the casting speed is preferably 1.80 m/min or less, more preferably 1.75 m/min or less, and further preferably 1.70 m/min or less. The lower limit is also not particularly limited but is preferably 1.25 m/min or more and more preferably 1.30 m/min or more in view of productivity.

[Hot Rolling Step]

Steel (steel slab) having the foregoing element composition is subjected to hot rolling. The slab heating temperature is not particularly limited. However, by setting the slab heating temperature to 1,200° C. or higher, it is expected that dissolution of sulfides is promoted, Mn segregation is suppressed, and the amount of the above-mentioned coarse inclusions is reduced. Consequently, delayed fracture resistance tends to be enhanced. Accordingly, the slab heating temperature is preferably 1,200° C. or higher and more preferably 1,220° C. or higher. Moreover, the heating rate during the slab heating is preferably 5° C. to 15° C./min, and the slab soaking time is preferably 30 to 100 minutes.

The finishing delivery temperature is preferably 840° C. or higher. When the finishing delivery temperature is lower than 840° C., it takes time to lower the temperature, thereby forming inclusions. Consequently, not only the delayed fracture resistance deteriorates, but also the inner quality of a steel sheet could deteriorate. Accordingly, the finishing delivery temperature is preferably 840° C. or higher and more preferably 860° C. or higher. Meanwhile, although the upper limit is not particularly limited, the finishing delivery temperature is preferably 950° C. or lower and more preferably 920° C. or lower since cooling to the following coiling temperature becomes difficult.

The cooled hot-rolled steel sheet is preferably coiled at a temperature of 630° C. or lower. When the coiling temperature exceeds 630° C., there is a risk of decarburization of the base steel surface. Consequently, a nonuniform alloy concentration could result due to a difference in microstructure between the inside and the surface of the steel sheet. Moreover, decarburization of the surface layer reduces an area fraction of bainite and/or martensite containing carbide grains in the steel sheet surface layer. Consequently, it tends to be difficult to ensure a desirable strength. Accordingly, the coiling temperature is preferably 630° C. or lower and more preferably 600° C. or lower. The lower limit of the coiling temperature is not particularly limited but is preferably 500° C. or higher to prevent deterioration in cold rolling properties.

[Cold Rolling Step]

In the cold rolling step, the coiled hot-rolled steel sheet is pickled and then cold-rolled to produce a cold-rolled steel sheet. Pickling conditions are not particularly limited. When the reduction is less than 20%, the surface flatness deteriorates and the microstructure could become nonuniform. Accordingly, the reduction is preferably 20% or more, more preferably 30% or more, and further preferably 40% or more.

[Annealing Step]

A steel sheet after cold rolling is heated to an annealing temperature of $A_{c3}$ point or higher. When the annealing temperature is lower than $A_{c3}$ point, it is impossible to attain a desirable strength due to formation of ferrite in the microstructure. Accordingly, the annealing temperature is $A_{c3}$ point or higher, preferably ($A_{c3}$ point+10° C.) or higher, and more preferably ($A_{c3}$ point+20° C.) or higher. Although the upper limit of the annealing temperature is not particularly limited, the annealing temperature is preferably 900° C. or lower from a viewpoint of suppressing coarsening of austenite and preventing deterioration in delayed fracture resistance. Here, after heating to an annealing temperature of $A_{c3}$ point or higher, soaking may be performed at the annealing temperature.

$A_{c3}$ point is calculated by the following equation. In the following equation, "(% atomic symbol)" indicates the content (mass %) of each element.

$$A_{c3}\text{ point (° C.)}=910-203\sqrt{(\%\text{ C})}+45(\%\text{ Si})-30(\%\text{ Mn})-20(\%\text{ Cu})-15(\%\text{ Ni})+11(\%\text{ Cr})+32(\%\text{ Mo})+104(\%\text{ V})+400(\%\text{ Ti})+460(\%\text{ Al})$$

After heated to an annealing temperature of $A_{c3}$ point or higher as described above, the cold-rolled steel sheet is subjected to cooling to a cooling stop temperature of 350° C. or lower at an average cooling rate of 3° C./s or more in the temperature range from the annealing temperature to 550° C. and then held in the temperature range of 100° C. or higher and 260° C. or lower for 20 seconds or more and 1,500 seconds or less.

When the average cooling rate in the temperature range from the annealing temperature to 550° C. is less than 3° C./s, the resulting excessive formation of ferrite makes it difficult to attain a desirable strength. Moreover, formation of ferrite in the surface layer makes it difficult to attain a predetermined fraction of bainite and/or martensite that contain carbide grains in the vicinity of the surface layer. Consequently, delayed fracture resistance deteriorates. Accordingly, the average cooling rate in the temperature range from the annealing temperature to 550° C. is 3° C./s or more, preferably 5° C./s or more, and more preferably 10° C./s or more. Meanwhile, the upper limit of the average cooling rate is not particularly limited. However, when the cooling rate becomes excessively fast, nonuniform martensite transformation tends to occur in the coil width direction. Consequently, there is a risk of contact between the steel sheet and equipment due to shape deterioration. Accordingly, the upper limit is preferably 3,000° C./s or less from a viewpoint of obtaining a minimally acceptable shape.

The average cooling rate in the temperature range from the annealing temperature to 550° C. is "(annealing temperature−550° C.)/(cooling time from annealing temperature to 550° C.)" unless otherwise indicated.

The cooling stop temperature is 350° C. or lower. When the cooling stop temperature exceeds 350° C., tempering fails to proceed satisfactorily while excessively forming carbide-free as-quenched martensite and retained austenite in the final microstructure. Consequently, delayed fracture resistance deteriorates due to the reduced amount of fine carbide grains in the steel sheet surface layer. Accordingly, to attain excellent delayed fracture resistance, the cooling stop temperature is 350° C. or lower, preferably 300° C. or lower, and more preferably 250° C. or lower.

Carbide grains distributed inside the bainite are carbide grains formed during holding in a low-temperature range after quenching. Such carbide grains trap hydrogen by acting as trapping sites of hydrogen and thus can prevent deterioration in delayed fracture resistance. When the holding temperature is lower than 100° C. or the holding time is less than 20 seconds, bainite is not formed and carbide-free as-quenched martensite is formed. Consequently, it is impossible to obtain the above-mentioned effects due to the reduced amount of fine carbide grains in the steel sheet surface layer.

Moreover, when the holding temperature exceeds 260° C. or the holding time exceeds 1,500 seconds, delayed fracture resistance deteriorates due to decarburization as well as formation of coarse carbide grains inside the bainite.

Accordingly, the holding temperature is 100° C. or higher and 260° C. or lower, and the holding time is 20 seconds or more and 1,500 seconds or less. Moreover, the holding temperature is preferably 130° C. or higher and 240° C. or lower, and the holding time is preferably 50 seconds or more and 1,000 seconds or less.

Here, the hot-rolled steel sheet after the hot rolling may be subjected to heat treatment for softening the microstructure, or the steel sheet surface may be plated with Zn, Al, or the like. Moreover, temper rolling for shape control may be performed after annealing and cooling or after plating.

[Edge Surface Processing Step]

An embodiment of the method for manufacturing a high-strength member of the disclosed embodiments includes an edge surface processing step of, after cutting out a steel sheet, subjecting an edge surface formed by cutting to surface trimming before or after bending, and heating the edge surface at a temperature of 270° C. or lower after the bending and the surface trimming.

The "cutting" in the disclosed embodiments means cutting that encompasses publicly known cuttings, such as shear cutting (mechanical cutting), laser cutting, discharge processing or other electric cuttings, and gas cutting.

By performing the edge surface processing step, it is possible to eliminate microcracks formed during cutting out of a steel sheet and to reduce residual stress, thereby suppressing formation of cracks on the edge surface of a bent ridge portion and thus obtaining a member having excellent delayed fracture resistance. The amount of the edge surface to be surface-trimmed is not particularly limited provided that the length of the longest crack among cracks that extend from the edge surface of the bent ridge portion in a bent ridge direction can be controlled to 10 μm or less. However, to lower residual stress, it is preferable to remove 200 μm or more from the surface and is more preferable to remove 250 μm or more. Further, the surface trimming method for the edge surface is not particularly limited, and any method of laser, grinding, and coining, for example, may be employed. Either bending or surface trimming of the edge surface may be performed first; surface trimming of the edge surface may be performed after bending, or bending may be performed after surface trimming of the edge surface.

To lower the residual stress of the edge surface, a formed member obtained after subjecting the steel sheet to the above-mentioned bending and surface trimming is heated at a temperature of 270° C. or lower. When the heating temperature exceeds 270° C., it is difficult to attain a desirable TS since the tempering of the martensite microstructure proceeds. Accordingly, the heating temperature is 270° C. or lower and preferably 250° C. or lower. Moreover, the lower limit of the heating temperature or the heating time is not particularly limited provided that the residual stress of the edge surface of the bent ridge portion can be controlled to 800 MPa or less.

Here, heating at a temperature of 270° C. or lower may be performed as heating for baking coatings.

Further, in this heating, at least the surface-trimmed edge surface may be heated, or the entire steel sheet may be heated.

EXAMPLES

The disclosed embodiments will be specifically described with reference to the Examples. The disclosed embodiments, however, are not limited to these Examples.

1. Manufacture of Members for Evaluation

Steels having element compositions shown in Table 1, with the balance being Fe and unavoidable impurities, were smelted in a vacuum melting furnace at various casting speeds and then slabbed to obtain slabbed materials having a thickness of 27 mm. The resulting slab materials were hot-rolled into a sheet thickness of 4.0 to 2.8 mm to produce hot-rolled steel sheets. Subsequently, the hot-rolled steel sheets were cold-rolled into a sheet thickness of 1.4 mm to produce cold-rolled steel sheets. After that, the cold-rolled steel sheets obtained as described above were subjected to heat treatments under the conditions shown in Tables 2 to 4 (annealing step). The blank cells in the element composition of Table 1 indicate that the corresponding elements are not added intentionally and encompass the case of not containing (0 mass %) as well as the case of containing incidentally. Details of the respective conditions for the hot rolling step, cold rolling step, and annealing step are shown in Tables 2 to 4.

The steel sheet after heat treatment was sheared into 30 mm×110 mm pieces. In some samples, edge surfaces formed by shearing were subjected to surface trimming by laser or grinding before bending. Subsequently, a steel sheet sample was subjected to V-bending by placing on a die having an angle of 90° and pressing the steel sheet with a punch having an angle of 90°. After that, as illustrated in the side view of FIG. 2, the steel sheet (member) after bending was tightened with a bolt 20 from both sides of the plate faces of the steel sheet 11 using the bolt 20, a nut 21, and a taper washer 22. The relationship between the applied stress and the amount of tightening was calculated by CAE (computer-aided engineering) analysis, and the amount of tightening was controlled to be the same as the critical load stress. The critical load stress was measured by the method described hereinafter.

Figure 2:
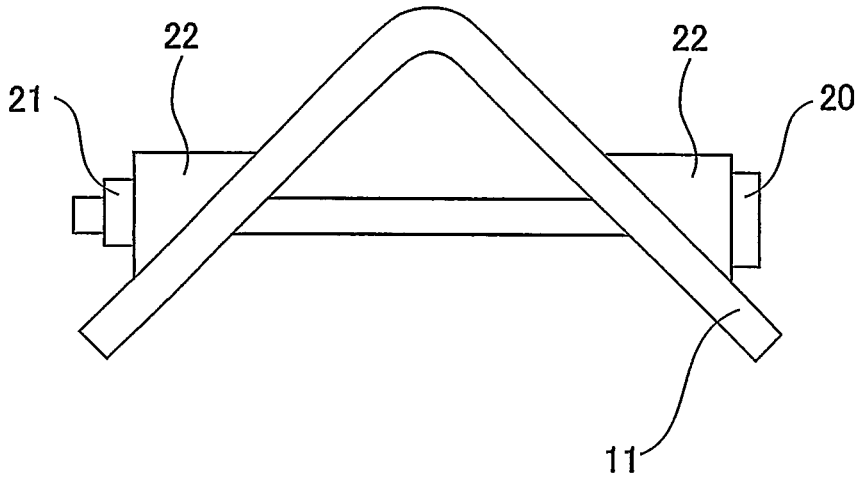
FIG. 2 is a side view illustrating the state of a member tightened with a bolt and a nut in a working example.

Some samples whose edge surfaces had not been subjected to surface trimming before bending were bent and then tightened with the bolt 20 as illustrated in FIG. 2 in the same manner as the foregoing at amounts of tightening corresponding to various critical load stresses. Subsequently, the edge surfaces were removed (surface-trimmed) by laser or grinding.

After bending and surface trimming, some samples were subjected to heat treatment at various heating temperatures. The respective conditions for edge surface processing are shown in Tables 2 to 4. Regarding edge surface processing in Tables 2 to 4, the dash "-" in the column of surface trimming means that surface trimming was not performed, and the dash "-" in the column of heat treatment temperature (° C.) means that heat treatment was not performed.

TABLE 1

| Type of steel | Element composition (mass %) C | Si | Mn | P | S | Al | N | Sb | Others | $A_{c3}$ (° C.) |
|---|---|---|---|---|---|---|---|---|---|---|
| A | 0.21 | 0.20 | 1.2 | 0.007 | 0.0008 | 0.05 | 0.0021 | 0.01 | | 813 |
| B | 0.31 | 0.20 | 1.2 | 0.008 | 0.0003 | 0.07 | 0.0048 | 0.01 | | 801 |
| C | 0.17 | 0.20 | 2.8 | 0.008 | 0.0005 | 0.08 | 0.0021 | 0.02 | | 788 |
| D | 0.34 | 0.90 | 1.1 | 0.018 | 0.0002 | 0.02 | 0.0043 | 0.01 | | 809 |
| E | 0.18 | 0.02 | 1.8 | 0.010 | 0.0010 | 0.08 | 0.0043 | 0.01 | | 806 |
| F | 0.19 | 0.85 | 3.0 | 0.010 | 0.0010 | 0.05 | 0.0058 | 0.04 | | 792 |
| G | 0.28 | 1.15 | 1.1 | 0.007 | 0.0004 | 0.04 | 0.0014 | 0.01 | | 838 |
| H | 0.29 | 0.30 | 1.0 | 0.007 | 0.0010 | 0.08 | 0.0034 | 0.02 | | 820 |
| I | 0.23 | 0.12 | 3.2 | 0.006 | 0.0007 | 0.10 | 0.0046 | 0.03 | | 766 |
| J | 0.31 | 0.40 | 1.2 | 0.015 | 0.0002 | 0.09 | 0.0028 | 0.01 | | 821 |
| K | 0.32 | 0.38 | 1.2 | 0.009 | 0.0009 | 0.03 | 0.0031 | 0.005 | | 788 |
| L | 0.22 | 0.01 | 2.7 | 0.016 | 0.0004 | 0.04 | 0.0028 | 0.003 | B: 0.0020 | 752 |
| M | 0.23 | 0.07 | 2.8 | 0.005 | 0.0004 | 0.05 | 0.0015 | 0.07 | B: 0.0032 | 755 |
| N | 0.22 | 0.21 | 2.8 | 0.006 | 0.0010 | 0.07 | 0.0053 | 0.09 | B: 0.0004 | 771 |
| O | 0.23 | 0.30 | 2.9 | 0.018 | 0.0006 | 0.05 | 0.0040 | 0.01 | Nb: 0.0150 | 763 |
| P | 0.26 | 0.09 | 1.7 | 0.006 | 0.0002 | 0.06 | 0.0027 | 0.01 | Nb: 0.0700 | 788 |
| Q | 0.24 | 0.75 | 2.4 | 0.009 | 0.0002 | 0.06 | 0.0051 | 0.05 | Nb: 0.0025 | 801 |
| R | 0.24 | 0.11 | 2.5 | 0.007 | 0.0004 | 0.04 | 0.0051 | 0.01 | Ti: 0.017 | 765 |
| S | 0.25 | 0.10 | 2.3 | 0.006 | 0.0003 | 0.04 | 0.0037 | 0.01 | Ti: 0.090 | 798 |
| T | 0.26 | 0.04 | 2.2 | 0.017 | 0.0005 | 0.03 | 0.0019 | 0.06 | Ti: 0.003 | 759 |
| U | 0.28 | 0.20 | 1.6 | 0.009 | 0.0003 | 0.10 | 0.0060 | 0.01 | Cu: 0.15 | 805 |
| V | 0.28 | 0.60 | 1.6 | 0.015 | 0.0010 | 0.10 | 0.0020 | 0.02 | Cu: 0.90 | 808 |
| W | 0.26 | 0.12 | 1.8 | 0.008 | 0.0010 | 0.07 | 0.0020 | 0.02 | Cu: 0.02 | 789 |
| X | 0.22 | 0.35 | 2.7 | 0.009 | 0.0001 | 0.06 | 0.0043 | 0.01 | B: 0.0025, Ti: 0.015, Ni: 0.12 | 780 |
| Y | 0.23 | 1.10 | 2.8 | 0.009 | 0.0009 | 0.04 | 0.0029 | 0.03 | Nb: 0.0130, Cr: 0.05, Mo: 0.05 | 800 |
| Z | 0.25 | 1.00 | 2.4 | 0.009 | 0.0007 | 0.03 | 0.0039 | 0.03 | Cu: 0.13, Cr: 0.03, V: 0.012 | 796 |
| AA | 0.24 | 0.10 | 2.6 | 0.018 | 0.0010 | 0.03 | 0.0033 | 0.04 | Zr: 0.009, W: 0.01, Ca: 0.0008, Ce: 0.0009, La: 0.0006, Mg: 0.0005 | 753 |
| AB | 0.27 | 0.10 | 1.8 | 0.007 | 0.0007 | 0.06 | 0.0027 | 0.01 | Sn: 0.004 | 783 |
| AC | 0.21 | 0.10 | 1.2 | 0.005 | 0.0008 | 0.05 | 0.0021 | | | 813 |
| AD | 0.26 | 0.50 | 2.2 | 0.005 | 0.0005 | 0.03 | 0.0019 | | | 759 |
| AE | 0.37 | 0.20 | 1.2 | 0.019 | 0.0002 | 0.04 | 0.0021 | 0.01 | | 776 |
| AF | 0.14 | 0.90 | 3.0 | 0.006 | 0.0002 | 0.08 | 0.0055 | 0.01 | | 820 |
| AG | 0.21 | 2.40 | 2.8 | 0.008 | 0.0010 | 0.02 | 0.0028 | 0.01 | | 852 |
| AH | 0.22 | 0.12 | 3.4 | 0.014 | 0.0006 | 0.07 | 0.0024 | 0.01 | | 750 |
| AI | 0.26 | 0.16 | 0.8 | 0.008 | 0.0007 | 0.06 | 0.0010 | 0.01 | | 817 |
| AJ | 0.28 | 0.84 | 1.4 | 0.030 | 0.0004 | 0.07 | 0.0058 | 0.01 | | 830 |
| AK | 0.26 | 0.07 | 1.5 | 0.007 | 0.0020 | 0.06 | 0.0028 | 0.01 | | 792 |
| AL | 0.25 | 0.11 | 1.6 | 0.006 | 0.0003 | 0.25 | 0.0021 | 0.01 | | 880 |
| AM | 0.21 | 0.05 | 2.9 | 0.018 | 0.0008 | 0.07 | 0.0015 | 0.15 | | 765 |
| AN | 0.18 | 0.01 | 3.0 | 0.009 | 0.0005 | 0.08 | 0.0015 | 0.02 | B: 0.0040 | 770 |
| AO | 0.25 | 0.04 | 1.8 | 0.009 | 0.0002 | 0.05 | 0.0057 | 0.02 | Nb: 0.100 | 781 |
| AP | 0.24 | 0.15 | 2.0 | 0.006 | 0.0009 | 0.07 | 0.0054 | 0.02 | Ti: 0.140 | 846 |

TABLE 2

| No. | Type of steel | Hot rolling *1 (° C.) | *2 (° C.) | *3 (° C.) | Cold rolling Reduction (%) | Annealing temperature (° C.) | *4 (° C./s) | *5 (° C.) | Holding temperature (° C.) | Holding time (s) | Edge surface processing *6 | *7 | Heat treatment temperature (° C.) | Note |
|---|---|---|---|---|---|---|---|---|---|---|---|---|---|---|
| 1 | A | 1250 | 880 | 550 | 56 | 880 | 2000 | 150 | 150 | 100 | — | — | — | Comp. Ex. |
| 2 | | 1250 | 880 | 550 | 56 | 860 | 2000 | 150 | 200 | 100 | — | — | — | Comp. Ex. |
| 3 | | 1250 | 880 | 550 | 56 | 860 | 2000 | 250 | 150 | 100 | — | — | — | Comp. Ex. |
| 4 | | 1250 | 880 | 550 | 56 | 860 | 2000 | 150 | 150 | 100 | laser | — | 250 | Ex. |
| 5 | | 1250 | 880 | 550 | 56 | 860 | 2000 | 150 | 150 | 100 | grinding | — | 250 | Ex. |
| 6 | | 1250 | 880 | 550 | 56 | 860 | 2000 | 150 | 150 | 100 | grinding | — | 180 | Ex. |
| 7 | B | 1250 | 880 | 550 | 56 | 860 | 2000 | 150 | 150 | 100 | laser | — | 150 | Ex. |
| 8 | | 1250 | 880 | 550 | 56 | 860 | 2000 | 150 | 150 | 100 | laser | — | 220 | Ex. |
| 9 | | 1250 | 880 | 550 | 56 | 860 | 2000 | 150 | 150 | 100 | laser | — | 280 | Comp. Ex. |
| 10 | | 1250 | 880 | 550 | 56 | 860 | 2000 | 150 | 150 | 100 | grinding | — | 150 | Ex. |
| 11 | | 1250 | 880 | 550 | 56 | 860 | 2000 | 150 | 150 | 100 | grinding | — | 220 | Ex. |
| 12 | | 1250 | 880 | 550 | 56 | 860 | 2000 | 150 | 150 | 100 | grinding | — | 280 | Comp. Ex. |
| 13 | C | 1210 | 880 | 550 | 56 | 860 | 10 | 150 | 150 | 100 | laser | — | 240 | Ex. |
| 14 | | 1230 | 880 | 550 | 56 | 860 | 10 | 150 | 150 | 100 | laser | — | 250 | Ex. |

TABLE 2-continued

| No. | Type of steel | Hot rolling *1 (° C.) | Hot rolling *2 (° C.) | Hot rolling *3 (° C.) | Cold rolling Reduction (%) | Annealing Annealing temperature (° C.) | Annealing *4 (° C./s) | Annealing *5 (° C.) | Annealing Holding temperature (° C.) | Annealing Holding time (s) | Edge surface processing *6 | Edge surface processing *7 | Heat treatment temperature (° C.) | Note |
|---|---|---|---|---|---|---|---|---|---|---|---|---|---|---|
| 15 | | 1280 | 880 | 550 | 56 | 860 | 10 | 150 | 150 | 100 | laser | — | 230 | Ex. |
| 16 | | 1300 | 880 | 550 | 56 | 860 | 10 | 150 | 150 | 100 | laser | — | 180 | Ex. |
| 17 | D | 1280 | 850 | 550 | 56 | 860 | 2000 | 150 | 150 | 100 | laser | — | 200 | Ex. |
| 18 | | 1280 | 860 | 550 | 56 | 860 | 2000 | 150 | 150 | 100 | laser | — | 210 | Ex. |
| 19 | | 1280 | 880 | 550 | 56 | 860 | 2000 | 150 | 150 | 100 | laser | — | 170 | Ex. |
| 20 | | 1280 | 900 | 550 | 56 | 860 | 2000 | 150 | 150 | 100 | laser | — | 240 | Ex. |
| 21 | E | 1280 | 880 | 550 | 56 | 860 | 2000 | 150 | 150 | 100 | laser | — | — | Comp. Ex. |
| 22 | | 1280 | 880 | 550 | 56 | 860 | 2000 | 150 | 150 | 100 | laser | — | 140 | Ex. |
| 23 | | 1280 | 880 | 550 | 56 | 860 | 2000 | 150 | 150 | 100 | laser | — | 180 | Ex. |
| 24 | | 1280 | 880 | 550 | 56 | 860 | 2000 | 150 | 150 | 100 | laser | — | 220 | Ex. |
| 25 | | 1280 | 880 | 550 | 56 | 860 | 2000 | 150 | 150 | 100 | laser | — | 250 | Ex. |
| 26 | | 1280 | 880 | 550 | 56 | 860 | 2000 | 150 | 150 | 100 | laser | — | 280 | Comp. Ex. |
| 27 | F | 1280 | 880 | 550 | 56 | 860 | 10 | 150 | 150 | 100 | grinding | — | 250 | Ex. |
| 28 | | 1280 | 880 | 550 | 56 | 860 | 10 | 200 | 150 | 100 | grinding | — | 250 | Ex. |
| 29 | | 1280 | 880 | 550 | 56 | 860 | 10 | 250 | 150 | 100 | grinding | — | 250 | Ex. |
| 30 | | 1280 | 880 | 550 | 56 | 860 | 10 | 300 | 150 | 100 | grinding | — | 250 | Ex. |
| 31 | | 1280 | 880 | 550 | 56 | 860 | 10 | 350 | 150 | 100 | grinding | — | 250 | Ex. |
| 32 | | 1280 | 880 | 550 | 56 | 860 | 10 | 400 | 150 | 100 | grinding | — | 250 | Comp. Ex. |
| 33 | G | 1280 | 880 | 550 | 56 | 860 | 2000 | 150 | 150 | 100 | grinding | — | 250 | Ex. |
| 34 | | 1280 | 880 | 550 | 56 | 860 | 2000 | 150 | 200 | 100 | grinding | — | 250 | Ex. |
| 35 | | 1280 | 880 | 550 | 56 | 860 | 2000 | 150 | 220 | 100 | grinding | — | 250 | Ex. |
| 36 | | 1280 | 880 | 550 | 56 | 860 | 2000 | 150 | 270 | 100 | grinding | — | 250 | Comp. Ex. |
| 37 | H | 1280 | 880 | 550 | 56 | 860 | 2000 | 150 | 150 | 100 | grinding | — | 250 | Ex. |
| 38 | | 1280 | 880 | 550 | 40 | 860 | 2000 | 150 | 150 | 100 | grinding | — | 250 | Ex. |
| 39 | | 1280 | 880 | 550 | 30 | 860 | 2000 | 150 | 150 | 100 | grinding | — | 250 | Ex. |
| 40 | | 1280 | 880 | 550 | 20 | 860 | 2000 | 150 | 150 | 100 | grinding | — | 250 | Ex. |

*1: Slab heating temperature,
*2: Finishing delivery temperature,
*3: Coiling temperature
*4: Average cooling rate in temperature range from annealing temperature to 550° C.,
*5: Cooling stop temperature
*6: Surface trimming before bending,
*7: Surface trimming after bending

TABLE 3

| No. | Type of steel | Hot rolling *1 (° C.) | Hot rolling *2 (° C.) | Hot rolling *3 (° C.) | Cold rolling Reduction (%) | Annealing Annealing temperature (° C.) | Annealing *4 (° C./s) | Annealing *5 (° C.) | Annealing Holding temperature (° C.) | Annealing Holding time (s) | Edge surface processing *6 | Edge surface processing *7 | Heat treatment temperature (° C.) | Note |
|---|---|---|---|---|---|---|---|---|---|---|---|---|---|---|
| 41 | I | 1280 | 880 | 550 | 56 | 900 | 10 | 150 | 150 | 100 | grinding | — | 250 | Ex. |
| 42 | | 1280 | 880 | 550 | 56 | 850 | 10 | 150 | 150 | 100 | grinding | — | 250 | Ex. |
| 43 | | 1280 | 880 | 550 | 56 | 800 | 10 | 150 | 150 | 100 | grinding | — | 250 | Ex. |
| 44 | | 1280 | 880 | 550 | 56 | 750 | 10 | 150 | 150 | 100 | grinding | — | 250 | Comp. Ex. |
| 45 | J | 1250 | 880 | 550 | 56 | 860 | 2000 | 150 | 150 | 100 | grinding | — | 250 | Ex. |
| 46 | | 1250 | 880 | 550 | 56 | 860 | 2000 | 200 | 150 | 100 | grinding | — | 250 | Ex. |
| 47 | | 1250 | 880 | 550 | 56 | 860 | 2000 | 250 | 150 | 100 | grinding | — | 250 | Ex. |
| 48 | | 1250 | 880 | 550 | 56 | 860 | 2000 | 300 | 150 | 100 | grinding | — | 250 | Ex. |
| 49 | | 1250 | 880 | 550 | 56 | 860 | 2000 | 350 | 150 | 100 | grinding | — | 250 | Ex. |
| 50 | | 1250 | 880 | 550 | 56 | 860 | 2000 | 400 | 150 | 100 | grinding | — | 250 | Comp. Ex. |
| 51 | K | 1250 | 880 | 550 | 56 | 860 | 2000 | 150 | 150 | 100 | — | — | 250 | Comp. Ex. |
| 52 | | 1250 | 880 | 550 | 56 | 860 | 2000 | 150 | 150 | 100 | laser | — | 250 | Ex. |
| 53 | | 1250 | 880 | 550 | 56 | 860 | 2000 | 150 | 150 | 100 | grinding | — | 250 | Ex. |
| 54 | | 1250 | 880 | 550 | 56 | 860 | 2000 | 150 | 150 | 100 | laser | — | — | Comp. Ex. |
| 55 | | 1250 | 880 | 550 | 56 | 860 | 2000 | 150 | 150 | 100 | grinding | — | — | Comp. Ex. |
| 56 | | 1250 | 880 | 550 | 56 | 860 | 2000 | 150 | 150 | 100 | laser | — | 220 | Ex. |
| 57 | L | 1250 | 880 | 550 | 56 | 860 | 10 | 150 | 150 | 100 | — | laser | 250 | Ex. |
| 58 | | 1250 | 880 | 550 | 56 | 800 | 10 | 150 | 150 | 100 | — | laser | 250 | Ex. |
| 59 | | 1250 | 880 | 550 | 56 | 740 | 10 | 150 | 150 | 100 | — | laser | 250 | Comp. Ex. |
| 60 | M | 1250 | 880 | 550 | 56 | 860 | 10 | 150 | 150 | 100 | — | laser | 250 | Ex. |
| 61 | | 1250 | 880 | 550 | 56 | 860 | 8 | 150 | 150 | 100 | — | laser | 250 | Ex. |
| 62 | | 1250 | 880 | 550 | 56 | 860 | 5 | 150 | 150 | 100 | — | laser | 250 | Ex. |
| 63 | N | 1250 | 880 | 550 | 56 | 860 | 7 | 150 | 150 | 100 | — | laser | 250 | Ex. |

TABLE 3-continued

| No. | Type of steel | Hot rolling *1 (° C.) | Hot rolling *2 (° C.) | Hot rolling *3 (° C.) | Cold rolling Reduction (%) | Annealing temperature (° C.) | Annealing *4 (° C./s) | Annealing *5 (° C.) | Annealing Holding temperature (° C.) | Annealing Holding time (s) | Edge surface processing *6 | Edge surface processing *7 | Heat treatment temperature (° C.) | Note |
|---|---|---|---|---|---|---|---|---|---|---|---|---|---|---|
| 64 | | 1250 | 880 | 550 | 56 | 860 | 3 | 150 | 150 | 100 | — | laser | 250 | Ex. |
| 65 | | 1250 | 880 | 550 | 56 | 860 | 1 | 150 | 150 | 100 | — | laser | 250 | Comp. Ex. |
| 66 | O | 1250 | 880 | 550 | 56 | 860 | 10 | 150 | 150 | 100 | — | laser | 250 | Ex. |
| 67 | | 1250 | 880 | 550 | 56 | 860 | 10 | 180 | 150 | 100 | — | laser | 250 | Ex. |
| 68 | | 1250 | 880 | 550 | 56 | 860 | 10 | 150 | 150 | 100 | — | laser | 250 | Ex. |
| 69 | P | 1250 | 880 | 550 | 56 | 860 | 2000 | 150 | 150 | 100 | — | laser | 250 | Ex. |
| 70 | | 1250 | 880 | 550 | 56 | 860 | 2000 | 180 | 150 | 100 | — | laser | 250 | Ex. |
| 71 | | 1250 | 880 | 550 | 56 | 860 | 2000 | 200 | 150 | 100 | — | laser | 250 | Ex. |
| 72 | Q | 1250 | 880 | 550 | 56 | 860 | 10 | 150 | 150 | 100 | — | laser | 250 | Ex. |
| 73 | | 1250 | 880 | 550 | 56 | 860 | 10 | 150 | 100 | 100 | — | laser | 250 | Ex. |
| 74 | | 1250 | 880 | 550 | 56 | 860 | 10 | 150 | 70 | 100 | — | laser | 250 | Comp. Ex. |
| 75 | R | 1250 | 880 | 550 | 56 | 860 | 10 | 150 | 150 | 100 | — | laser | 250 | Ex. |
| 76 | | 1250 | 880 | 550 | 56 | 860 | 10 | 150 | 220 | 100 | — | laser | 250 | Ex. |
| 77 | | 1250 | 880 | 550 | 56 | 860 | 10 | 150 | 270 | 100 | — | laser | 250 | Comp. Ex. |
| 78 | S | 1250 | 880 | 550 | 56 | 860 | 10 | 150 | 150 | 100 | — | laser | 250 | Ex. |
| 79 | | 1250 | 880 | 550 | 56 | 860 | 10 | 150 | 150 | 80 | — | laser | 250 | Ex. |
| 80 | | 1250 | 880 | 550 | 56 | 860 | 10 | 150 | 150 | 50 | — | laser | 250 | Ex. |

*1: Slab heating temperature,
*2: Finishing delivery temperature,
*3: Coiling temperature
*4: Average cooling rate in temperature range from annealing temperature to 550° C.,
*5: Cooling stop temperature
*6: Surface trimming before bending,
*7: Surface trimming after bending

TABLE 4

| No. | Type of steel | Hot rolling *1 (° C.) | Hot rolling *2 (° C.) | Hot rolling *3 (° C.) | Cold rolling Reduction (%) | Annealing temperature (° C.) | Annealing *4 (° C./s) | Annealing *5 (° C.) | Annealing Holding temperature (° C.) | Annealing Holding time (s) | Edge surface processing *6 | Edge surface processing *7 | Heat treatment temperature (° C.) | Note |
|---|---|---|---|---|---|---|---|---|---|---|---|---|---|---|
| 81 | T | 1280 | 880 | 550 | 56 | 860 | 10 | 150 | 150 | 10 | — | laser | 250 | Comp. Ex. |
| 82 | | 1280 | 880 | 550 | 56 | 860 | 10 | 150 | 150 | 1000 | — | laser | 250 | Ex. |
| 83 | | 1280 | 880 | 550 | 56 | 860 | 10 | 150 | 150 | 1700 | — | grinding | — | Comp. Ex. |
| 84 | U | 1280 | 880 | 550 | 56 | 860 | 2000 | 150 | 150 | 100 | — | grinding | 250 | Ex. |
| 85 | | 1280 | 880 | 550 | 56 | 860 | 2000 | 150 | 150 | 100 | — | — | 220 | Comp. Ex. |
| 86 | | 1280 | 880 | 550 | 56 | 860 | 2000 | 150 | 150 | 100 | — | grinding | 200 | Ex. |
| 87 | V | 1280 | 880 | 550 | 56 | 860 | 2000 | 150 | 150 | 100 | — | grinding | 200 | Ex. |
| 88 | | 1280 | 880 | 550 | 56 | 860 | 2000 | 150 | 150 | 100 | — | — | 250 | Comp. Ex. |
| 89 | | 1280 | 880 | 550 | 56 | 860 | 2000 | 150 | 150 | 100 | — | grinding | — | Comp. Ex. |
| 90 | W | 1280 | 880 | 550 | 56 | 860 | 2000 | 150 | 150 | 100 | — | — | — | Comp. Ex. |
| 91 | | 1280 | 880 | 550 | 56 | 860 | 2000 | 150 | 150 | 100 | — | laser | 140 | Ex. |
| 92 | | 1280 | 880 | 550 | 56 | 860 | 2000 | 150 | 150 | 100 | — | laser | 200 | Ex. |
| 93 | X | 1280 | 880 | 550 | 56 | 860 | 10 | 150 | 150 | 100 | — | laser | 220 | Ex. |
| 94 | | 1280 | 880 | 550 | 56 | 860 | 10 | 150 | 150 | 100 | — | laser | 250 | Ex. |
| 95 | | 1280 | 880 | 550 | 56 | 860 | 10 | 150 | 150 | 100 | — | laser | 280 | Comp. Ex. |
| 96 | Y | 1280 | 880 | 550 | 56 | 780 | 10 | 150 | 150 | 100 | — | laser | 250 | Comp. Ex. |
| 97 | | 1280 | 880 | 550 | 56 | 820 | 10 | 150 | 150 | 100 | — | laser | 250 | Ex. |
| 98 | | 1280 | 880 | 550 | 56 | 860 | 10 | 150 | 150 | 100 | — | laser | 250 | Ex. |
| 99 | Z | 1280 | 880 | 550 | 56 | 860 | 10 | 150 | 150 | 100 | — | laser | 250 | Ex. |
| 100 | | 1280 | 880 | 550 | 56 | 860 | 30 | 250 | 150 | 100 | — | laser | 250 | Ex. |
| 101 | | 1280 | 880 | 550 | 56 | 860 | 50 | 400 | 150 | 100 | — | laser | 250 | Comp. Ex. |
| 102 | AA | 1280 | 880 | 500 | 56 | 860 | 10 | 150 | 150 | 100 | — | laser | 250 | Ex. |
| 103 | | 1280 | 880 | 550 | 56 | 860 | 10 | 200 | 150 | 100 | — | laser | 250 | Ex. |
| 104 | | 1280 | 880 | 600 | 56 | 860 | 10 | 250 | 150 | 100 | — | laser | 250 | Ex. |
| 105 | AB | 1280 | 880 | 550 | 56 | 860 | 2000 | 150 | 150 | 100 | — | laser | 250 | Ex. |
| 106 | | 1280 | 880 | 550 | 56 | 860 | 2000 | 250 | 170 | 100 | — | laser | 250 | Ex. |
| 107 | | 1280 | 880 | 550 | 56 | 860 | 2000 | 380 | 220 | 100 | — | laser | 250 | Comp. Ex. |
| 108 | AC | 1280 | 880 | 550 | 56 | 860 | 1500 | 150 | 150 | 100 | laser | — | 80 | Ex. |
| 109 | | 1280 | 880 | 550 | 56 | 860 | 1500 | 150 | 150 | 100 | laser | — | 170 | Ex. |
| 110 | AD | 1280 | 880 | 550 | 56 | 860 | 1500 | 150 | 150 | 100 | laser | — | 250 | Ex. |
| 111 | | 1280 | 880 | 550 | 56 | 860 | 1500 | 150 | 150 | 100 | laser | — | 120 | Ex. |
| 112 | AE | 1280 | 880 | 550 | 56 | 860 | 2000 | 150 | 150 | 100 | laser | — | 250 | Comp. Ex. |

TABLE 4-continued

| No. | Type of steel | Hot rolling *1 (° C.) | Hot rolling *2 (° C.) | Hot rolling *3 (° C.) | Cold rolling Reduction (%) | Annealing temperature (° C.) | Annealing *4 (° C./s) | Annealing *5 (° C.) | Annealing Holding temperature (° C.) | Annealing Holding time (s) | Edge surface processing *6 | Edge surface processing *7 | Heat treatment temperature (° C.) | Note |
|---|---|---|---|---|---|---|---|---|---|---|---|---|---|---|
| 113 | AF | 1280 | 880 | 550 | 56 | 860 | 10 | 150 | 150 | 100 | laser | — | 250 | Comp. Ex. |
| 114 | AG | 1280 | 880 | 550 | 56 | 860 | 10 | 150 | 150 | 100 | laser | — | 250 | Comp. Ex. |
| 115 | AH | 1280 | 880 | 550 | 56 | 860 | 10 | 150 | 150 | 100 | laser | — | 250 | Comp. Ex. |
| 116 | AI | 1280 | 880 | 550 | 56 | 860 | 2000 | 150 | 150 | 100 | laser | — | 250 | Comp. Ex. |
| 117 | AJ | 1280 | 880 | 550 | 56 | 860 | 2000 | 150 | 150 | 100 | laser | — | 250 | Comp. Ex. |
| 118 | AK | 1280 | 880 | 550 | 56 | 860 | 2000 | 150 | 150 | 100 | laser | — | 250 | Comp. Ex. |
| 119 | AL | 1280 | 880 | 550 | 56 | 900 | 2000 | 150 | 150 | 100 | laser | — | 250 | Comp. Ex. |
| 120 | AM | 1280 | 880 | 550 | 56 | 860 | 10 | 150 | 150 | 100 | laser | — | 250 | Comp. Ex. |
| 121 | AN | 1280 | 880 | 550 | 56 | 860 | 10 | 150 | 150 | 100 | laser | — | 250 | Comp. Ex. |
| 122 | AO | 1280 | 880 | 550 | 56 | 860 | 2000 | 150 | 150 | 100 | laser | — | 250 | Comp. Ex. |
| 123 | AP | 1280 | 880 | 550 | 56 | 860 | 10 | 150 | 150 | 100 | laser | — | 250 | Comp. Ex. |

*1: Slab heating temperature,
*2: Finishing delivery temperature,
*3: Coiling temperature
*4: Average cooling rate in temperature range from annealing temperature to 550° C.,
*5: Cooling stop temperature
*6: Surface trimming before bending,
*7: Surface trimming after bending 2. Evaluation Methods For the members obtained under various manufacturing conditions, the microstructure fraction was investigated by analyzing the steel structure (microstructure), the tensile characteristics, such as tensile strength, were assessed by performing a tensile test, and the delayed fracture resistance was evaluated by a critical load stress measured by a delayed fracture test. Each evaluation method is as follows.

(Total Area Fraction of One or Two of Bainite that Contains Carbide Grains Having Average Grain Size of 50 nm or Less and Martensite that Contains Carbide Grains Having Average Grain Size of 50 nm or Less)

A specimen was taken in the perpendicular direction from a steel sheet obtained in the annealing step (hereinafter, referred to as annealed steel sheet). The L-section in the sheet thickness direction parallel to the rolling direction was mirror-polished and etched with nital to expose the microstructure. The microstructure was then observed under a scanning electron microscope. On the SEM image of magnification 1,500×, a 16 mm×15 mm grid with 4.8-μm intervals was placed on a 82 μm×57 μm region in actual length. By a point counting method for counting points on each phase, the area fractions of martensite that contains carbide grains having an average grain size of 50 nm or less and bainite that contains carbide grains having an average grain size of 50 nm or less were calculated, and then the total area fraction was calculated. Each area fraction was an average of three area fractions obtained from separate SEM images of magnification 1,500×. Martensite is a white microstructure, and bainite is a black microstructure within which fine carbide grains are precipitated. The average grain size of carbide grains was calculated as follows. Here, the area fraction is an area fraction relative to the entire observed range, which was regarded as an area fraction relative to the entire microstructure of a steel sheet.

(Average Grain Size of Carbide Grains Inside Bainite and Martensite)

A specimen was taken in the perpendicular direction to the rolling direction of an annealed steel sheet. The L-section in the sheet thickness direction parallel to the rolling direction was mirror-polished and etched with nital to expose the microstructure. The microstructure was then observed under a scanning electron microscope. On the SEM image of magnification 5,000×, the total area of carbide grains was measured through image analysis by binarization. By averaging the total area by the number, an area of single carbide grain was calculated. An equivalent circle diameter obtained from the area of each carbide grain was regarded as an average grain size.

(Tensile Test)

A JIS No. 5 specimen having a gauge length of 50 mm, a gauge width of 25 mm, and thickness of 1.4 mm was taken in the rolling direction of an annealed steel sheet. Tensile strength (TS) and yield strength (YS) were measured by a tensile test at a tensile speed of 10 mm/min in accordance with JIS Z 2241 (2011).

(Measurement of Critical Load Stress)

A critical load stress was measured by a delayed fracture test. Specifically, each of the members obtained under the respective manufacturing conditions was immersed in hydrochloric acid at pH=1 (25° C.) and evaluated by a maximum applied stress without delayed fracture as a critical load stress. Delayed fracture was judged visually and on an image of magnification up to 20× by a stereo microscope. A case without cracking after immersing for 96 hours was regarded as fracture free. Here, "cracking" indicates the case in which a crack having a crack length of 200 μm or more is formed.

(Measurement of Edge Surface Residual Stress)

Figure 3:
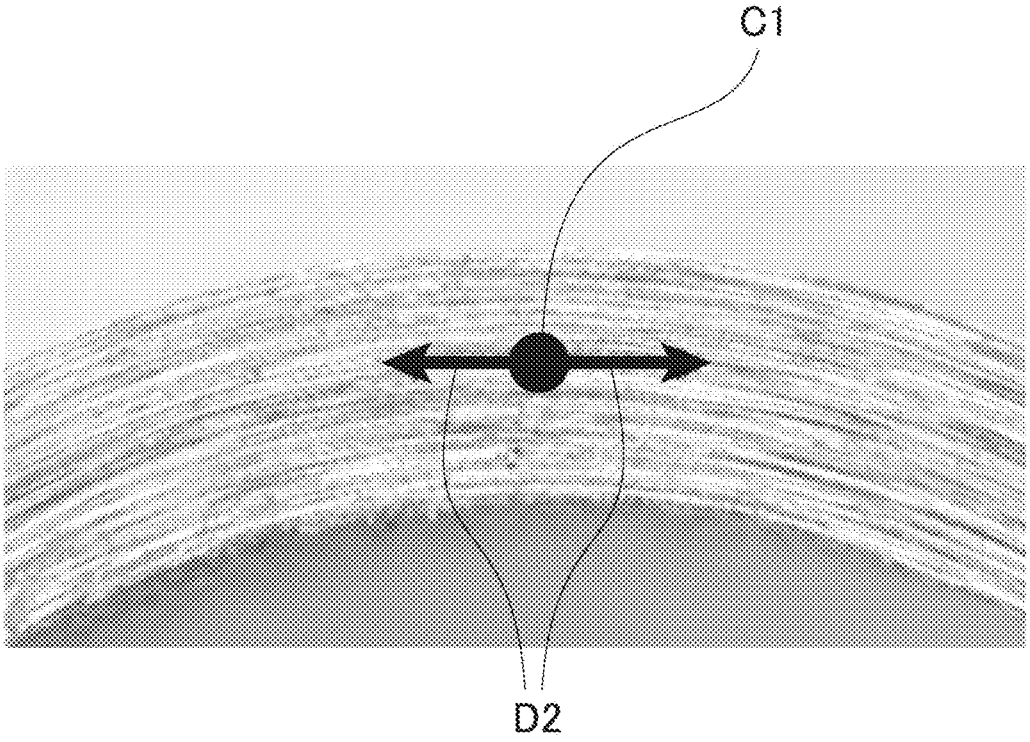
FIG. 3 is an enlarged view of an edge surface showing a sheet thickness center, as a measurement point, and a measurement direction in measurement of residual stress of the edge surface in a working example.

For the members obtained under the respective manufacturing conditions, the edge surface residual stress was measured by X-ray diffraction. The measurement point for residual stress was at the sheet thickness center on the edge surface of a bent ridge portion, and the irradiation diameter of X-ray was set to 150 μm. The measurement direction was set perpendicular to the sheet thickness direction as well as perpendicular to the bent ridge direction. FIG. 3 is an enlarged view of the edge surface of a bent ridge portion and shows the sheet thickness center and the measurement direction denoted by signs C1 and D2, respectively.

(Measurement of Crack Length on Edge Surface)

For each of the members obtained under the respective manufacturing conditions, the lengths of cracks that extend from the edge surface of the bent ridge portion in a bent ridge direction were measured by a stereo microscope at magnification of 50×. The length of the longest crack among the cracks that extend from the edge surface of the bent ridge portion in the bent ridge direction is shown in Tables 5 to 7.

3. Evaluation Results

The above-described evaluation results are shown in Tables 5 to 7.

TABLE 5

| | | | Mechanical properties | | | | Delayed fracture resistance | | |
|---|---|---|---|---|---|---|---|---|---|
| No. | Type of steel | Steel microstructure *1 (%) | YS (MPa) | TS (MPa) | Edge surface residual stress (MPa) | *2 (μm) | Critical load stress (MPa) | *3 | Note |
| 1 | A | 94 | 1512 | 1810 | 1420 | 30 | 1422 | 0.94 | Comp. Ex. |
| 2 | | 95 | 1452 | 1720 | 1420 | 20 | 1351 | 0.93 | Comp. Ex. |
| 3 | | 95 | 1537 | 1820 | 1400 | 20 | 1337 | 0.87 | Comp. Ex. |
| 4 | | 96 | 1376 | 1800 | 200 | 0 | 1761 | 1.28 | Ex. |
| 5 | | 92 | 1480 | 1810 | 200 | 0 | 1776 | 1.20 | Ex. |
| 6 | | 98 | 1551 | 1780 | 300 | 0 | 1907 | 1.23 | Ex. |
| 7 | B | 95 | 1512 | 1790 | 640 | 0 | 1844 | 1.22 | Ex. |
| 8 | | 100 | 1609 | 1810 | 380 | 0 | 1947 | 1.21 | Ex. |
| 9 | | 83 | 1324 | 1320 | 100 | 30 | 1231 | 0.93 | Comp. Ex. |
| 10 | | 99 | 1364 | 1550 | 400 | 0 | 1664 | 1.22 | Ex. |
| 11 | | 96 | 1306 | 1530 | 380 | 0 | 1632 | 1.25 | Ex. |
| 12 | | 88 | 1232 | 1390 | 80 | 30 | 1096 | 0.89 | Comp. Ex. |
| 13 | C | 94 | 1320 | 1580 | 260 | 0 | 1690 | 1.28 | Ex. |
| 14 | | 96 | 1357 | 1590 | 200 | 0 | 1696 | 1.25 | Ex. |
| 15 | | 100 | 1431 | 1610 | 320 | 0 | 1660 | 1.16 | Ex. |
| 16 | | 90 | 1248 | 1560 | 400 | 0 | 1485 | 1.19 | Ex. |
| 17 | D | 98 | 1368 | 1570 | 500 | 0 | 1682 | 1.23 | Ex. |
| 18 | | 93 | 1637 | 1980 | 440 | 0 | 2062 | 1.26 | Ex. |
| 19 | | 97 | 1733 | 2010 | 680 | 0 | 2097 | 1.21 | Ex. |
| 20 | | 99 | 1760 | 2000 | 260 | 0 | 2094 | 1.19 | Ex. |
| 21 | E | 93 | 1629 | 1970 | 1100 | 0 | 1498 | 0.92 | Comp. Ex. |
| 22 | | 92 | 1369 | 1770 | 630 | 0 | 1588 | 1.16 | Ex. |
| 23 | | 91 | 1448 | 1790 | 620 | 0 | 1752 | 1.21 | Ex. |
| 24 | | 100 | 1618 | 1820 | 380 | 0 | 1958 | 1.21 | Ex. |
| 25 | | 90 | 1224 | 1580 | 200 | 0 | 1542 | 1.26 | Ex. |
| 26 | | 80 | 1424 | 1380 | 50 | 25 | 1267 | 0.89 | Comp. Ex. |
| 27 | F | 100 | 1609 | 1810 | 200 | 0 | 1947 | 1.21 | Ex. |
| 28 | | 97 | 1496 | 1790 | 200 | 0 | 1914 | 1.28 | Ex. |
| 29 | | 98 | 1568 | 1800 | 200 | 0 | 1929 | 1.23 | Ex. |
| 30 | | 93 | 1432 | 1670 | 200 | 0 | 1732 | 1.21 | Ex. |
| 31 | | 91 | 1503 | 1580 | 200 | 0 | 1909 | 1.27 | Ex. |
| 32 | | 88 | 1559 | 1390 | 200 | 0 | 1528 | 0.98 | Comp. Ex. |
| 33 | G | 94 | 1291 | 1650 | 200 | 8 | 1613 | 1.25 | Ex. |
| 34 | | 93 | 1344 | 1680 | 200 | 7 | 1653 | 1.23 | Ex. |
| 35 | | 91 | 1430 | 1630 | 200 | 8 | 1845 | 1.29 | Ex. |
| 36 | | 82 | 1423 | 1340 | 200 | 15 | 1352 | 0.95 | Comp. Ex. |
| 37 | H | 96 | 1493 | 1750 | 200 | 0 | 1897 | 1.27 | Ex. |
| 38 | | 99 | 1549 | 1760 | 200 | 0 | 1890 | 1.22 | Ex. |
| 39 | | 86 | 1170 | 1530 | 200 | 0 | 1497 | 1.28 | Ex. |
| 40 | | 91 | 1246 | 1540 | 200 | 0 | 1507 | 1.21 | Ex. |

*1: Total area ratio of one or two of bainite that contains carbide grains having average grain size of 50 nm or less and martensite that contains carbide grains having average grain size of 50 nm or less

*2: Length of longest crack among cracks that extend from edge surface of bent ridge portion in bent ridge direction

*3: Critical load stress/YS

TABLE 6

| | | | Mechanical properties | | | | Delayed fracture resistance | | |
|---|---|---|---|---|---|---|---|---|---|
| No. | Type of steel | Steel microstructure *1 (%) | YS (MPa) | TS (MPa) | Edge surface residual stress (MPa) | *2 (μm) | Critical load stress (MPa) | *3 | Note |
| 41 | I | 98 | 1287 | 1540 | 200 | 4 | 1647 | 1.28 | Ex. |
| 42 | | 98 | 1359 | 1560 | 200 | 5 | 1671 | 1.23 | Ex. |
| 43 | | 93 | 1273 | 1540 | 200 | 4 | 1642 | 1.29 | Ex. |
| 44 | | 85 | 1309 | 1350 | 60 | 4 | 1662 | 1.27 | Comp. Ex. |
| 45 | J | 100 | 1671 | 1880 | 200 | 0 | 2022 | 1.21 | Ex. |

TABLE 6-continued

| No. | Type of steel | Steel microstructure *1 (%) | Mechanical properties YS (MPa) | TS (MPa) | Edge surface residual stress (MPa) | *2 (μm) | Delayed fracture resistance Critical load stress (MPa) | *3 | Note |
|---|---|---|---|---|---|---|---|---|---|
| 46 | | 96 | 1464 | 1810 | 200 | 0 | 1772 | 1.21 | Ex. |
| 47 | | 94 | 1521 | 1820 | 200 | 0 | 1947 | 1.28 | Ex. |
| 48 | | 91 | 1488 | 1740 | 200 | 0 | 1801 | 1.21 | Ex. |
| 49 | | 90 | 1671 | 1680 | 200 | 0 | 2022 | 1.21 | Ex. |
| 50 | | 78 | 1629 | 1370 | 200 | 0 | 1515 | 0.93 | Comp. Ex. |
| 51 | K | 93 | 1158 | 1570 | 1200 | 20 | 1066 | 0.92 | Comp. Ex. |
| 52 | | 92 | 1325 | 1620 | 200 | 0 | 1590 | 1.20 | Ex. |
| 53 | | 97 | 1440 | 1670 | 200 | 0 | 1785 | 1.24 | Ex. |
| 54 | | 91 | 1278 | 1580 | 1000 | 0 | 1227 | 0.96 | Comp. Ex. |
| 55 | | 95 | 1351 | 1600 | 1200 | 0 | 1311 | 0.97 | Comp. Ex. |
| 56 | | 92 | 1086 | 1490 | 380 | 0 | 1336 | 1.23 | Ex. |
| 57 | L | 93 | 1356 | 1640 | 200 | 0 | 1749 | 1.29 | Ex. |
| 58 | | 90 | 1296 | 1520 | 200 | 0 | 1594 | 1.23 | Ex. |
| 59 | | 80 | 1074 | 1310 | 80 | 0 | 1364 | 1.27 | Comp. Ex. |
| 60 | M | 95 | 1288 | 1670 | 200 | 0 | 1584 | 1.23 | Ex. |
| 61 | | 94 | 1379 | 1650 | 200 | 0 | 1765 | 1.28 | Ex. |
| 62 | | 93 | 1455 | 1620 | 200 | 0 | 1789 | 1.23 | Ex. |
| 63 | N | 95 | 1537 | 1820 | 200 | 0 | 1952 | 1.27 | Ex. |
| 64 | | 91 | 1496 | 1710 | 200 | 0 | 1930 | 1.29 | Ex. |
| 65 | | 81 | 1570 | 1440 | 200 | 0 | 1507 | 0.96 | Comp. Ex. |
| 66 | O | 91 | 1335 | 1650 | 200 | 0 | 1628 | 1.22 | Ex. |
| 67 | | 90 | 1312 | 1640 | 200 | 0 | 1614 | 1.23 | Ex. |
| 68 | | 97 | 1449 | 1680 | 200 | 0 | 1796 | 1.24 | Ex. |
| 69 | P | 96 | 1408 | 1650 | 200 | 0 | 1774 | 1.26 | Ex. |
| 70 | | 97 | 1431 | 1660 | 200 | 0 | 1775 | 1.24 | Ex. |
| 71 | | 94 | 1370 | 1640 | 200 | 0 | 1754 | 1.28 | Ex. |
| 72 | Q | 94 | 1420 | 1700 | 200 | 0 | 1818 | 1.28 | Ex. |
| 73 | | 91 | 1327 | 1640 | 400 | 0 | 1618 | 1.22 | Ex. |
| 74 | | 80 | 1304 | 1630 | 500 | 15 | 1213 | 0.93 | Comp. Ex. |
| 75 | R | 94 | 1613 | 1930 | 200 | 0 | 2064 | 1.28 | Ex. |
| 76 | | 100 | 1742 | 1960 | 500 | 7 | 2108 | 1.21 | Ex. |
| 77 | | 87 | 1415 | 1830 | 400 | 30 | 1373 | 0.97 | Comp. Ex. |
| 78 | S | 100 | 1591 | 1790 | 200 | 0 | 1925 | 1.21 | Ex. |
| 79 | | 92 | 1415 | 1730 | 200 | 0 | 1698 | 1.20 | Ex. |
| 80 | | 92 | 1203 | 1650 | 200 | 0 | 1491 | 1.24 | Ex. |

*1: Total area ratio of one or two of bainite that contains carbide grains having average grain size of 50 nm or less and martensite that contains carbide grains having average grain size of 50 nm or less
*2: Length of longest crack among cracks that extend from edge surface of bent ridge portion in bent ridge direction
*3: Critical load stress/YS

TABLE 7

| No. | Type of steel | Steel microstructure *1 (%) | Mechanical properties YS (MPa) | TS (MPa) | Edge surface residual stress (MPa) | *2 (μm) | Delayed fracture resistance Critical load stress (MPa) | *3 | Note |
|---|---|---|---|---|---|---|---|---|---|
| 81 | T | 85 | 1461 | 1730 | 400 | 20 | 1417 | 0.97 | Comp. Ex. |
| 82 | | 96 | 1485 | 1740 | 200 | 7 | 1871 | 1.26 | Ex. |
| 83 | | 87 | 1509 | 1750 | 600 | 30 | 1433 | 0.95 | Comp. Ex. |
| 84 | U | 97 | 1474 | 1710 | 200 | 0 | 1828 | 1.24 | Ex. |
| 85 | | 96 | 1451 | 1700 | 880 | 25 | 1378 | 0.95 | Comp. Ex. |
| 86 | | 94 | 1404 | 1680 | 500 | 0 | 1797 | 1.28 | Ex. |
| 87 | V | 96 | 1382 | 1620 | 500 | 0 | 1742 | 1.26 | Ex. |
| 88 | | 94 | 1362 | 1630 | 950 | 30 | 1335 | 0.98 | Comp. Ex. |
| 89 | | 94 | 1362 | 1630 | 1200 | 0 | 1335 | 0.98 | Comp. Ex. |
| 90 | W | 99 | 1478 | 1680 | 1400 | 35 | 1301 | 0.88 | Comp. Ex. |
| 91 | | 95 | 1402 | 1660 | 660 | 0 | 1626 | 1.16 | Ex. |
| 92 | | 98 | 1455 | 1670 | 500 | 0 | 1789 | 1.23 | Ex. |
| 93 | X | 94 | 1310 | 1630 | 380 | 0 | 1586 | 1.21 | Ex. |
| 94 | | 91 | 1362 | 1610 | 200 | 0 | 1743 | 1.28 | Ex. |
| 95 | | 86 | 1425 | 1440 | 40 | 0 | 1781 | 1.25 | Comp. Ex. |
| 96 | Y | 84 | 1354 | 1420 | 120 | 2 | 1719 | 1.27 | Comp. Ex. |
| 97 | | 99 | 1443 | 1640 | 200 | 3 | 1775 | 1.23 | Ex. |
| 98 | | 94 | 1362 | 1630 | 200 | 2 | 1743 | 1.28 | Ex. |

TABLE 7-continued

| No. | Type of steel | Steel microstructure *1 (%) | Mechanical properties YS (MPa) | TS (MPa) | Edge surface residual stress (MPa) | *2 (μm) | Delayed fracture resistance Critical load stress (MPa) | *3 | Note |
|---|---|---|---|---|---|---|---|---|---|
| 99 | Z | 93 | 1298 | 1570 | 200 | 2 | 1700 | 1.31 | Ex. |
| 100 | | 94 | 1312 | 1570 | 200 | 3 | 1692 | 1.29 | Ex. |
| 101 | | 82 | 1276 | 1360 | 200 | 3 | 1174 | 0.92 | Comp. Ex. |
| 102 | AA | 98 | 1334 | 1550 | 200 | 0 | 1668 | 1.25 | Ex. |
| 103 | | 94 | 1287 | 1540 | 200 | 0 | 1647 | 1.28 | Ex. |
| 104 | | 90 | 1224 | 1530 | 250 | 0 | 1530 | 1.25 | Ex. |
| 105 | AB | 99 | 1813 | 2060 | 200 | 0 | 2212 | 1.22 | Ex. |
| 106 | | 97 | 1013 | 1610 | 200 | 0 | 1276 | 1.26 | Ex. |
| 107 | | 98 | 1176 | 1380 | 200 | 4 | 1094 | 0.93 | Comp. Ex. |
| 108 | AC | 96 | 1220 | 1510 | 790 | 2 | 1244 | 1.02 | Ex. |
| 109 | | 97 | 1230 | 1520 | 300 | 0 | 1488 | 1.21 | Ex. |
| 110 | AD | 97 | 1510 | 1880 | 200 | 0 | 1872 | 1.24 | Ex. |
| 111 | | 97 | 1505 | 1870 | 720 | 2 | 1565 | 1.04 | Ex. |
| 112 | AE | 93 | 1521 | 1840 | 1100 | 0 | 1354 | 0.89 | Comp. Ex. |
| 113 | AF | 83 | 1055 | 1430 | 200 | 2 | 1287 | 1.22 | Comp. Ex. |
| 114 | AG | 92 | 1431 | 1750 | 900 | 20 | 1288 | 0.90 | Comp. Ex. |
| 115 | AH | 90 | 1384 | 1730 | 960 | 15 | 1218 | 0.88 | Comp. Ex. |
| 116 | AI | 80 | 1368 | 1410 | 200 | 0 | 1683 | 1.23 | Comp. Ex. |
| 117 | AJ | 93 | 1347 | 1630 | 200 | 30 | 1199 | 0.89 | Comp. Ex. |
| 118 | AK | 90 | 1356 | 1620 | 300 | 25 | 1193 | 0.88 | Comp. Ex. |
| 119 | AL | 96 | 1487 | 1660 | 200 | 25 | 1368 | 0.92 | Comp. Ex. |
| 120 | AM | 94 | 1513 | 1730 | 200 | 30 | 1407 | 0.93 | Comp. Ex. |
| 121 | AN | 93 | 1520 | 1740 | 200 | 20 | 1398 | 0.92 | Comp. Ex. |
| 122 | AO | 83 | 1515 | 1710 | 200 | 25 | 1409 | 0.93 | Comp. Ex. |
| 123 | AP | 84 | 1530 | 1730 | 200 | 25 | 1438 | 0.94 | Comp. Ex. |

*1: Total area ratio of one or two of bainite that contains carbide grains having average grain size of 50 nm or less and martensite that contains carbide grains having average grain size of 50 nm or less
*2: Length of longest crack among cracks that extend from edge surface of bent ridge portion in bent ridge direction
*3: Critical load stress/YS In the present working examples, members having TS≥1470 MPa and critical load stress≥YS are considered satisfactory and shown as Examples in Tables 5 to 7. Meanwhile, members having TS<1470 MPa or critical load stress<YS are considered unsatisfactory and shown as Comparative Examples in Tables 5 to 7. In Tables 5 to 7, "critical load stress/YS" of 1.00 or more means critical load stress≥YS.

As shown in Tables 5 to 7, the members of the Examples have high strength and excellent delayed fracture resistance.

The invention claimed is:

1. A high-strength member formed from a steel sheet, the member comprising:

a bent ridge portion having an edge surface, wherein:

the member has a tensile strength of 1470 MPa or more, the edge surface of the bent ridge portion has a residual stress of 800 MPa or less, a longest crack among cracks that extend from the edge surface of the bent ridge portion in a bent ridge direction has a length of 10 μm or less, and the steel sheet has a chemical composition comprising, by mass %:

C: 0.17% or more and 0.35% or less;

Si: 0.001% or more and 1.2% or less;

Mn: 0.9% or more and 3.2% or less;

P: 0.02% or less;

S: 0.001% or less;

Al: 0.01% or more and 0.2% or less;

N: 0.010% or less; and the balance being Fe and incidental impurities.

2. The high-strength member according to claim 1, wherein the steel sheet has a microstructure including at least one of (i) bainite containing carbide grains having an average grain size of 50 nm or less and (ii) martensite containing carbide grains having an average grain size of 50 nm or less with a total area fraction of 90% or more based on an entire microstructure of the steel sheet.

3. The high-strength member according to claim 2, wherein the chemical composition further comprises, by mass %, at least one Group selected from the group consisting of:

Group A: B: 0.0002% or more and less than 0.0035%,

Group B: at least one selected from the group consisting of Nb: 0.002% or more and 0.08% or less, and Ti: 0.002% or more and 0.12% or less, Group C: at least one selected from the group consisting of Cu: 0.005% or more and 1% or less, and Ni: 0.005% or more and 1% or less, Group D: at least one selected from the group consisting of Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less, Group E: at least one selected from the group consisting of Ca: 0.0002% or more and 0.0030% or less, Ce: 0.0002% or more and 0.0030% or less, La: 0.0002% or more and 0.0030% or less, and Mg: 0.0002% or more and 0.0030% or less, and Group F: Sn: 0.002% or more and 0.1% or less.

4. The high-strength member according to claim 1, wherein:

the steel sheet has a microstructure including at least one of (i) bainite containing carbide grains having an average grain size of 50 nm or less and (ii) martensite containing carbide grains having an average grain size of 50 nm or less with a total area fraction of 90% or more based on an entire microstructure of the steel sheet, and the chemical composition further comprises, by mass %, Sb: 0.001% or more and 0.1% or less.

5. The high-strength member according to claim 4, wherein the chemical composition further comprises, by mass %, at least one Group selected from the group consisting of:

Group A: B: 0.0002% or more and less than 0.0035%,

Group B: at least one selected from the group consisting of Nb: 0.002% or more and 0.08% or less, and Ti: 0.002% or more and 0.12% or less, Group C: at least one selected from the group consisting of Cu: 0.005% or more and 1% or less, and Ni: 0.005% or more and 1% or less, Group D: at least one selected from the group consisting of Cr: 0.01% or more and 1.0% or less, Mo: 0.01% or more and less than 0.3%, V: 0.003% or more and 0.5% or less, Zr: 0.005% or more and 0.20% or less, and W: 0.005% or more and 0.20% or less, Group E: at least one selected from the group consisting of Ca: 0.0002% or more and 0.0030% or less, Ce: 0.0002% or more and 0.0030% or less, La: 0.0002% or more and 0.0030% or less, and Mg: 0.0002% or more and 0.0030% or less, and Group F: Sn: 0.002% or more and 0.1% or less.

6. The high-strength member according to claim 1, wherein the edge surface of the bent ridge portion has a residual stress of 600 MPa or less.

7. The high-strength member according to claim 1, wherein the longest crack among cracks that extend from the edge surface of the bent ridge portion in the bent ridge direction has a length of 5 μm or less.

8. The high-strength member according to claim 1, wherein the chemical composition comprises, by mass %, Mn: 1.8% or more and 3.2% or less.

9. A method for manufacturing the high-strength member according to claim 1, the method comprising:

cutting out the steel sheet;

bending the steel sheet after the cutting;

subjecting an edge surface of the steel sheet formed by the cutting to a surface trimming before or after the bending; and heating the edge surface of the steel sheet at a temperature of 270° C. or lower after the bending and the surface trimming.

10. A method for manufacturing the high-strength member according to claim 2, the method comprising:

cutting out the steel sheet;

bending the steel sheet after the cutting;

subjecting an edge surface of the steel sheet formed by the cutting to a surface trimming before or after a bending; and heating the edge surface of the steel sheet at a temperature of 270° C. or lower after the bending and the surface trimming.

11. A method for manufacturing the high-strength member according to claim 4, the method comprising:

cutting out the steel sheet;

bending the steel sheet after the cutting;

subjecting an edge surface of the steel sheet formed by the cutting to a surface trimming before or after a bending; and heating the edge surface of the steel sheet at a temperature of 270° C. or lower after the bending and the surface trimming.

12. A method for manufacturing the high-strength member according to claim 3, the method comprising:

cutting out the steel sheet;

bending the steel sheet after the cutting;

subjecting an edge surface of the steel sheet formed by the cutting to a surface trimming before or after a bending; and heating the edge surface of the steel sheet at a temperature of 270° C. or lower after the bending and the surface trimming.

13. A method for manufacturing the high-strength member according to claim 5, the method comprising:

cutting out the steel sheet;

bending the steel sheet after the cutting;

subjecting an edge surface of the steel sheet formed by the cutting to a surface trimming before or after a bending; and heating the edge surface of the steel sheet at a temperature of 270° C. or lower after the bending and the surface trimming.

* * * * *